US009649679B2

(12) United States Patent
Nikaido et al.

(10) Patent No.: US 9,649,679 B2
(45) Date of Patent: May 16, 2017

(54) WATER-BLOCKING APPARATUS AND WATER-BLOCKING METHOD FOR COOLING WATER FOR HOT-ROLLED STEEL SHEET

(71) Applicant: Nippon Steel & Sumitomo Metal Corporation, Tokyo (JP)

(72) Inventors: Hitoshi Nikaido, Tokyo (JP); Yoshihiro Serizawa, Tokyo (JP); Noriyuki Hishinuma, Tokyo (JP)

(73) Assignee: NIPPON STEEL SUMITOMO METAL CORPORATION, Tokyo (JP)

( * ) Notice: Subject to any disclaimer, the term of this patent is extended or adjusted under 35 U.S.C. 154(b) by 111 days.

(21) Appl. No.: 14/395,154

(22) PCT Filed: Jun. 6, 2013

(86) PCT No.: PCT/JP2013/065647

§ 371 (c)(1),
(2) Date: Oct. 17, 2014

(87) PCT Pub. No.: WO2013/183694

PCT Pub. Date: Dec. 12, 2013

(65) Prior Publication Data

US 2015/0101386 A1 Apr. 16, 2015

(30) Foreign Application Priority Data

Jun. 8, 2012 (JP) ..... 2012-130630
Sep. 6, 2012 (JP) ..... 2012-196536

(51) Int. Cl.
*B21B 45/02* (2006.01)

(52) U.S. Cl.
CPC ..... *B21B 45/0233* (2013.01); *B21B 45/0218* (2013.01)

(58) Field of Classification Search
CPC ..... B21B 45/0203; B21B 45/0218; B21B 45/0233; B21B 15/005
See application file for complete search history.

(56) References Cited

U.S. PATENT DOCUMENTS

2009/0108509 A1* 4/2009 Seruzawa ..... B21B 45/0218 266/114
2010/0024505 A1* 2/2010 Ueoka ..... B21B 45/0233 72/202

FOREIGN PATENT DOCUMENTS

CN 201375987 1/2010
CN 201760451 3/2011
(Continued)

OTHER PUBLICATIONS

Office Action dated Dec. 2, 2014 issued in corresponding Chinese Application No. 201380002508.9 [with English Translation of Search Report].

(Continued)

*Primary Examiner* — Debra Sullivan
(74) *Attorney, Agent, or Firm* — Birch, Stewart, Kolasch & Birch, LLP

(57) ABSTRACT

A water-blocking apparatus for cooling water for a hot-rolled steel sheet according to the present invention, which blocks cooling water sprayed onto a hot-rolled steel sheet at a sprayed water density of higher than 4 $m^3/m^2/min$ and equal to or less than 10 $m^3/m^2/min$ when the hot-rolled steel sheet is cooled after finish rolling of a hot-rolling process, includes: a plurality of water-blocking nozzles which spray water-blocking water onto the hot-rolled steel sheet. Impact areas of the water-blocking water respectively sprayed from the water-blocking nozzles are continuously lined up in a straight line in a width direction of the hot-rolled steel sheet on a surface of the hot-rolled steel sheet and the adjacent impact areas partially overlap.

10 Claims, 5 Drawing Sheets

(56) References Cited

FOREIGN PATENT DOCUMENTS

| | | | |
|---|---|---|---|
| EP | 1952902 | A1 | 8/2008 |
| JP | 61-231125 | | 10/1986 |
| JP | 11-123439 | | 5/1999 |
| JP | 2001-240915 | A | 9/2001 |
| JP | 2001-276923 | | 10/2001 |
| JP | 2002-120011 | | 4/2002 |
| JP | 2004-306064 | | 11/2004 |
| JP | 2006-247714 | | 9/2006 |
| JP | 2007-152429 | | 6/2007 |
| JP | 2010-005683 | A | 1/2010 |
| JP | 2010-227966 | | 10/2010 |
| JP | 2010-253522 | | 11/2010 |
| JP | 2010-264498 | | 11/2010 |
| JP | 2012-051013 | | 3/2012 |

OTHER PUBLICATIONS

International Search Report dated Aug. 27, 2013 issued in corresponding PCT Application No. PCT/JP2013/065647 [with English Translation].
Notice of Allowance dated Apr. 22, 2014 issued in corresponding Japanese Application No. 2013-547760 [with English Translation].
Search Report dated Dec. 11, 2015 issued in corresponding European Application No. 13801187.9.

* cited by examiner

WATER-BLOCKING APPARATUS AND WATER-BLOCKING METHOD FOR COOLING WATER FOR HOT-ROLLED STEEL SHEET

TECHNICAL FIELD

This application is a national stage application of International Application No. PCT/JP2013/065647, filed Jun. 6, 2013, which claims priority to Japanese Patent Application No. 2012-130630, filed on Jun. 8, 2012 and Japanese Patent Application No. 2012-196536, filed on Sep. 6, 2012, each of which is incorporated by reference in its entirety.

The present invention relates to a water-blocking apparatus and a water-blocking method for blocking cooling water sprayed onto a hot-rolled steel sheet, particularly, cooling water having a sprayed water density of higher than 4 $m^3/m^2/min$ and equal to or less than 10 $m^3/m^2/min$ when the hot-rolled steel sheet is cooled after finish rolling of a hot-rolling process.

BACKGROUND ART

A hot-rolled steel sheet after finish rolling of a hot-rolling process is cooled by a cooling apparatus provided above and below a run-out table to a predetermined temperature while being transported by the run-out table from a finishing mill to a coiler, and is thereafter coiled by the coiler. In the hot rolling of the hot-rolled steel sheet, cooling manners after the finish rolling are important factors that determine mechanical properties, workability, weldability, and the like of the hot-rolled steel sheet, and thus it is important to uniformly cool the hot-rolled steel sheet to a predetermined temperature.

In the cooling process after the finish rolling, typically, the hot-rolled steel sheet is cooled by using, for example, water (hereinafter, called cooling water) as a coolant. Specifically, in a predetermined cooling area of the hot-rolled steel sheet, the hot-rolled steel sheet is cooled by using the cooling water. In addition, as described above, in order to uniformly cool the hot-rolled steel sheet to a predetermined temperature, there is a need to prevent extra cooling water on the upstream side or the downstream side of the cooling area from leaking.

Therefore, blocking the cooling water on the hot-rolled steel sheet is performed. As a water-blocking method for the cooling water, various methods have been proposed.

In Patent Document 1, arranging one or more rows of nozzles that spray water-blocking water from slit-shaped or circular nozzle spray holes on the downstream side of a cooling apparatus, that is, cooling nozzles that spray cooling water so that spray angles thereof are inclined toward the upstream side of a hot-rolled steel sheet in a sheet-threading direction is proposed. In addition, blocking the cooling water is performed by the water-blocking water sprayed onto the hot-rolled steel sheet from the nozzles.

In addition, in Patent Document 2, providing a water spray type water-blocking facility in a cooling apparatus and arranging air nozzle groups on the downstream side of the water spray type water-blocking facility is proposed. In addition, water-blocking water is sprayed onto a hot-rolled steel sheet from the water spray type water-blocking facility, and air is simultaneously ejected toward the hot-rolled steel sheet from the air nozzle groups in an air wind direction substantially perpendicular to a sheet-threading direction, thereby blocking the cooling water is performed.

Moreover, in Patent Document 3, a water-blocking apparatus which includes a header provided with nozzles that spray water-blocking water onto a hot-rolled steel sheet so that a momentum of the water-blocking water per unit time and unit width (a force of the water-blocking water) is maintained in a range of 1.5 to 5 times the momentum of cooling water that stays on the surface of the hot-rolled steel sheet per unit time and unit width (a force of the cooling water) to spray the water-blocking water onto the hot-rolled steel sheet from the nozzles is proposed.

PRIOR ART DOCUMENT

Patent Document

[Patent Document 1] Japanese Unexamined Patent Application, First Publication No. 2007-152429

[Patent Document 2] Japanese Unexamined Patent Application, First Publication No. 2010-227966

[Patent Document 3] Japanese Unexamined Patent Application, First Publication No. 2012-51013

SUMMARY OF THE INVENTION

Problems to be Solved by the Invention

Here, when the hot-rolled steel sheet is cooled, there may be cases where cooling water having a sprayed water density of, for example, higher than 4 $m^3/m^2/min$ and equal to or less than 10 $m^3/m^2/min$ is sprayed onto the hot-rolled steel sheet.

However, in Patent Document 1, only the spray angles of the nozzles that spray the water-blocking water are exemplified, and the other conditions, for example, a water amount or flow velocity of the water-blocking water are not disclosed. In addition, in Patent Document 2, conditions such as a water amount or flow velocity of the water-blocking water are not also disclosed. Moreover, in Patent Document 3, for example, as described in Examples and Table 1 of the specification of Patent Document 3, only the case where cooling water having a low sprayed water density of 4 $m^3/m^2/min$ or less is sprayed onto the hot-rolled steel sheet is considered. Therefore, the water-blocking methods described in Patent Documents 1 to 3 do not consider blocking the cooling water having a high sprayed water density at all, and there may be cases where cooling water having a high sprayed water density cannot be blocked.

In addition, in a case where water on a sheet caused by cooling water having a flow rate of 4 $m^3/m^2/min$ or less is blocked, as illustrated in FIG. 8, in a plan view, arranging impact areas 101 of water-blocking water which is sprayed from a plurality of flat spray nozzles 100 and impacts on the surface of a hot-rolled steel sheet 10, in the shape of a mountain so as not to interfere with each other may be considered. In this case, the flow of the water on the sheet in a sheet-threading direction (a negative Y direction in FIG. 8) is temporarily received by the flat spray nozzles 100 such that a flow in the width direction is generated, thereby discharging the water on the sheet by the flow. Since the width-direction components of the flow of the water-blocking water that do not interfere with each other are effectively operated, even when there is a gap between the water-blocking water, in the case of the cooling water having a flow rate of 4 $m^3/m^2/min$ or less, the cooling water rarely leaks as indicated by the inclined arrows in FIG. 8.

Furthermore, the inventors had intensively researched and found that in the case where cooling water having a high sprayed water density of higher than 4 $m^3/m^2/min$ and equal to or less than 10 $m^3/m^2/min$ is sprayed onto a hot-rolled steel sheet, when the momentum of water-blocking water is maintained in a range of 1.5 to 5 times the momentum of the cooling water as described in Patent Document 3, the water-blocking water submerges below the cooling water and the cooling ability of the cooling water to cool the hot-rolled steel sheet is degraded.

The present invention has been made taking the foregoing circumstances into consideration, and an object thereof is to, when a hot-rolled steel sheet after finish rolling of a hot-rolling process is cooled by a large amount of cooling water, to appropriately block the cooling water while appropriately cooling the hot-rolled steel sheet with the cooling water.

Means for Solving the Problems

The present invention employs the following means in order to accomplish the object to solve the problems. That is, (1) According to an aspect of the present invention, a water-blocking apparatus for cooling water for a hot-rolled steel sheet, which blocks cooling water sprayed onto a hot-rolled steel sheet at a sprayed water density of higher than 4 $m^3/m^2/min$ and equal to or less than 10 $m^3/m^2/min$ when the hot-rolled steel sheet is cooled after finish rolling of a hot-rolling process, includes: a plurality of water-blocking nozzles which spray water-blocking water onto the hot-rolled steel sheet. Impact areas of the water-blocking water respectively sprayed from the water-blocking nozzles are continuously lined up in a straight line in a width direction of the hot-rolled steel sheet on a surface of the hot-rolled steel sheet and the adjacent impact areas partially overlap.

As described above, in many cooling facilities according to the related art, the amount of cooling water is small, and there was no demand for blocking the cooling water in the vicinity of a cooling facility that uses a large amount of the cooling water (refer to Patent Documents 1 to 3). However, in recent years, since steel sheets having various materials are required, the amount of water used in cooling facilities is increased, and a water-blocking facility for preventing a large amount of water on a sheet from leaking is needed.

Therefore, as a result of intensive research by the inventors, it was proved that in a case where a hot-rolled steel sheet is cooled by cooling water having a high sprayed water density of higher than 4 $m'/m^2/min$ and equal to or less than 10 $m^3/m^2/min$, by satisfying the conditions in which impact areas of water-blocking water sprayed from a plurality of water-blocking nozzles are continuously lined up in a straight line in a width direction of the hot-rolled steel sheet on a surface of the hot-rolled steel sheet and the adjacent impact areas partially overlap, the cooling water can be appropriately blocked while appropriately cooling the hot-rolled steel sheet by the cooling water.

Hitherto, in the case where a small amount of cooling water is blocked, generally, a method of arranging impact areas of water-blocking water sprayed from a plurality of water-blocking nozzles onto a surface of a hot-rolled steel sheet in a wedge shape with respect to a flowing direction of the water on the sheet to push the water on the sheet to the left and the right was employed (see FIG. 8). In this water-blocking method according to the related art, even when there is a gap between the adjacent impact areas of the water-blocking water, in the case where the hot-rolled steel sheet is cooled by a small amount of the cooling water having a flow rate of 4 $m^3/m^2/min$ or less, the water on the sheet (the cooling water) does not leak from the gap as indicated by the inclined arrows in FIG. 8.

However, in a case where the hot-rolled steel sheet is cooled by the cooling water having a large amount of higher than 4 $m^3/m^2/min$ and equal to or less than 10 $m^3/m^2/min$, in the water-blocking method according to the related art as described above, the water on the sheet leaks from the gap between the adjacent impact areas of the water-blocking water as indicated by the inclined arrows in FIG. 8, and thus cooling of the hot-rolled steel sheet and blocking the cooling water could not be appropriately performed.

Therefore, first, the inventors had verified a water-blocking effect by adjusting the arrangement or spraying direction of nozzles for the water-blocking water to allow a plurality of impact areas of the water-blocking water to be continuously lined up in a straight line in the width direction of the hot-rolled steel sheet on the surface of the hot-rolled steel sheet. As a result, no gap was formed between the adjacent impact areas of the water-blocking water and thus an improvement in the leakage of the water on the sheet had succeeded compared to the method according to the related art. However, the inventors performed new examinations to cope with a larger amount of cooling water.

In the water-blocking method according to the related art to cope with a small amount of cooling water, as illustrated in FIG. 8, the arrangement of the water-blocking nozzles, the spraying direction of the water-blocking water, and the like are set so that the adjacent impact areas of the water-blocking water do not overlap (in other words, the water-blocking water does not interfere with each other). For example, even for the cooling water or high-pressure water for descaling, generally, the arrangement of nozzles, the spraying direction or water, and the like are set so that water sprayed from the nozzles does not interfere with each other. The reason is that it is difficult to predict the influence of the interference between the water sprayed from the nozzles pertaining to a cooling ability or a descaling ability and a large loss occurs in the water stream. Therefore, even in the water-blocking method according to the related art, the interference between the water-blocking water is avoided depending on a method of spraying the cooling water or the high-pressure water for descaling.

However, in the case where the water-blocking water is sprayed onto the hot-rolled steel sheet, there is no need to consider the influence of the interference between the water-blocking water pertaining to the cooling ability, the loss of the water stream, and the like, and leakage prevention of the water on the sheet by the water stream formed on the surface of the steel sheet by spraying the water-blocking water is the first object.

Therefore, regardless of the common technical knowledge according to the related art, the inventors had verified the water-blocking effect by adjusting the arrangement or spraying direction of the nozzles for the water-blocking water to allow the plurality of impact areas of the water-blocking water to be continuously lined up in a straight line in the width direction of the hot-rolled steel sheet on the surface of the hot-rolled steel sheet and to allow the adjacent impact areas to partially overlap (that is, the adjacent water-blocking water interferes with each other), and had succeeded in significantly improving the leakage of the water on the sheet compared to the method according to the related art even in the case where the hot-rolled steel sheet is cooled by the cooling water having a large amount of higher than 4 $m^3/m^2/min$ and equal to or less than 10 $m^3/m^2/min$.

The reason is that in addition to the absence of the gap between the adjacent impact areas of the water-blocking water, a strong water wall was formed by the interference between the adjacent water-blocking water, and thus the leakage of a large amount of water on the sheet at a high water level could be obstructed. In addition, as the verification result, it was confirmed that a problem of which the cause was thought to be the interference between the water-blocking water did not occur.

As described above, according to the water-blocking apparatus described in (I), the leakage of a large amount of water on the sheet (the cooling water) could be significantly improved compared to the method according to the related art. The configuration of the water-blocking apparatus can be realized because of the inventors who have changed the way of thinking apart from the general common technical knowledge according to the related art in order to cope with a large amount of cooling water which is difficult to be realized by those skilled in the art.

(2) In the water-blocking apparatus described in (1), a height at which sprays of the water-blocking water which are adjacent to each other in the width direction of the hot-rolled steel sheet join may be higher than 400 mm from the surface of the hot-rolled steel sheet in a side view as viewed from a sheet-threading direction of the hot-rolled steel sheet.

That is, the water-blocking water is present without gaps in the vertical direction to a height higher than 400 mm from the surface of the hot-rolled steel sheet. According to the verification by the inventors, it was proved that even in the case where the hot-rolled steel sheet is cooled by a large amount of cooling water, the height of the cooling water is lower than 400 mm from the surface of the hot-rolled steel sheet. Therefore, by satisfying the condition in which the height at which the adjacent sprays of the water-blocking water join is higher than 400 mm from the surface of the hot-rolled steel sheet, the cooling water does not overflow the water-blocking water and leak. In addition, particularly in the case where the cooling water having a high sprayed water density is sprayed onto the hot-rolled steel sheet, the cooling water is scattered vertically upward from the surface of the hot-rolled steel sheet. Therefore, it is preferable that the height condition of the water-blocking water be satisfied.

(3) In the water-blocking apparatus described in (1) or (2), a momentum $F_A$ of the water-blocking water that flows in the sheet-threading direction of the hot-rolled steel sheet on the surface of the hot-rolled steel sheet may be 1.0 to 1.5 times the momentum $F_B$ of the cooling water that flows in the sheet-threading direction of the hot-rolled steel sheet.

As such, since the momentum $F_A$ of the water-blocking water is equal to or greater than the momentum $F_B$ of the cooling water, the water-blocking water can block the cooling water, and thus the cooling water does not pass through the water-blocking water and leak. In contrast, according to the verification by the inventors, it was proved that when the momentum $F_A$ of the water-blocking water is greater than 1.5 times the momentum $F_B$ of the cooling water, the water-blocking water submerges below the cooling water, and the cooling ability of the cooling water to cool the hot-rolled steel sheet is degraded. Therefore, as described above, it is preferable that the momentum $F_A$ of the water-blocking water be 1.0 to 1.5 times the momentum $F_B$ of the cooling water.

In addition, as described above, in Patent Document 3, the momentum of the water-blocking water per unit time and unit width (a force of the water-blocking water) is 1.5 to 5 times the momentum of the cooling water per unit time and unit width (a force of the cooling water). This condition is a condition for blocking the cooling water when the hot-rolled steel sheet is cooled by the cooling water having a low sprayed water density of 4 $m^3/m^2/min$ or less (hereinafter, the range of this sprayed water density is called a low sprayed water density) as described in Examples and Table 1 of Patent Document 3, and cannot be applied to a case where the hot-rolled steel sheet is cooled by the cooling water having a high sprayed water density of higher than 4 $m^3/m^2/min$ and equal to or less than 10 $m^3/m^2/min$ (hereinafter, the range of this sprayed water density is called a high sprayed water density).

According to the verification by the inventors, it was proved that the case where the hot-rolled steel sheet is cooled by the cooling water having a low sprayed water density as described in Patent Document 3 and the case where the hot-rolled steel sheet is cooled by the cooling water having a high sprayed water density as in the present invention have different mechanisms of cooling the hot-rolled steel sheet.

For example, in the case where the hot-rolled steel sheet is cooled by the cooling water having a low sprayed water density, the dominant factor for defining the momentum of the cooling water is, for example, the depth (potential energy) of the cooling water that stays on the surface of the hot-rolled steel sheet as defined in paragraph 0019 of the specification of Patent Document 3 regarding the momentum of the cooling water. That is, the cooling water that stays on the surface of the hot-rolled steel sheet contributes the most to cooling of the hot-rolled steel sheet. In this case, the momentum of the cooling water is reduced. Therefore, when the momentum of the water-blocking water is equal to or greater than the momentum of the cooling water, the water-blocking water submerges below the cooling water, resulting in a different cooling ability than a case of cooling without blocking the cooling water.

In contrast, in the case where the hot-rolled steel sheet is cooled by the cooling water having a high sprayed water density as in the present invention, the dominant factor for defining the momentum $F_B$ of the cooling water is a horizontal component of the cooling water sprayed onto the hot-rolled steel sheet from the nozzles. That is, the cooling water sprayed from the nozzles contributes the most to cooling of the hot-rolled steel sheet. In this case, the momentum of the cooling water having a high sprayed water density is increased. Therefore, when the momentum $F_A$ of the water-blocking water is greater than 1.5 times the momentum $F_B$ of the cooling water, as described above, the water-blocking water submerges below the cooling water, and thus the cooling ability of the cooling water to cool the hot-rolled steel sheet is degraded.

(4) In the water-blocking apparatus described in any one of (1) to (3), the plurality of water-blocking nozzles may be lined up and arranged in the width direction of the hot-rolled steel sheet so that a distance between the water-blocking nozzle and the surface of the hot-rolled steel sheet in a spraying direction of the water-blocking water is 2000 mm or less.

According to the verification by the inventors, it was proved that in a case where the distance between the water-blocking nozzle and the surface of the hot-rolled steel sheet in the spraying direction of the water-blocking water exceeds 2000 mm, the water-blocking water sprayed from the water-blocking nozzle onto the hot-rolled steel sheet is damped by air resistance, the momentum of the water-blocking water is reduced, and there is a possibility that a large amount of the cooling water may not be appropriately blocked. Therefore, as described above, it is preferable that the distance between the water-blocking nozzle and the surface of the hot-rolled steel sheet in the spraying direction of the water-blocking water be set to be 2000 mm or less.

(5) In the water-blocking apparatus described in any one of (1) to (4), a spray angle of the water-blocking water sprayed from the water-blocking nozzle with respect to a vertical direction may be 20 to 65 degrees.

(6) in the water-blocking apparatus described in any one of (1) to (5), the plurality of water-blocking nozzles may be arranged on each of an upstream side and a downstream side of cooling water nozzles which sprays the cooling water onto the hot-rolled steel sheet.

(7) In the water-blocking apparatus described in any one of (1) to (6), the plurality of water-blocking nozzles may be flat spray nozzles.

(8) According to another aspect of the present invention, a water-blocking method for cooling water for a hot-rolled steel sheet, in which cooling water sprayed onto a hot-rolled steel sheet at a sprayed water density of higher than 4 $m^3/m^2/min$ and equal to or less than 10 $m^3/m^2/min$ when the hot-rolled steel sheet is cooled after finish rolling of a hot-rolling process is blocked, the water-blocking method includes: spraying water-blocking water from a plurality of water-blocking nozzles onto the hot-rolled steel sheet so that a plurality of impact areas of the water-blocking water are continuously lined up in a straight line in a width direction of the hot-rolled steel sheet on a surface of the hot-rolled steel sheet and the adjacent impact areas partially overlap.

(9) In the water-blocking method described in (8), a height at which sprays of the water-blocking water which are adjacent to each other in the width direction of the hot-rolled steel sheet join may be higher than 400 mm from the surface of the hot-rolled steel sheet in a side view as viewed from a sheet-threading direction of the hot-rolled steel sheet.

(10) In the water-blocking method described in (8) or (9), a momentum $F_A$ of the water-blocking water that flows in the sheet-threading direction of the hot-rolled steel sheet on the surface of the hot-rolled steel sheet may be 1.0 to 1.5 times the momentum $F_B$ of the cooling water that flows in the sheet-threading direction of the hot-rolled steel sheet.

(11) In the water-blocking method described in any one of (8) to (10), the plurality of water-blocking nozzles may be lined up and arranged in the width direction of the hot-rolled steel sheet so that a distance between the water-blocking nozzle and the surface of the hot-rolled steel sheet in a spraying direction of the water-blocking water is 2000 mm or less.

(12) In the water-blocking method described in any one of (8) to (11), a spray angle of the water-blocking water sprayed from the water-blocking nozzle with respect to a vertical direction may be 20 to 65 degrees.

(13) In the water-blocking method described in any one of (8) to (12), the plurality of water-blocking nozzles may be arranged on each of an upstream side and a downstream side of a cooling water nozzle which sprays the cooling water onto the hot-rolled steel sheet, and the cooling water on the upstream side and the downstream side of the cooling water nozzle may be blocked by the water-blocking water sprayed from the water-blocking nozzles disposed on the upstream side and the downstream side of the cooling water nozzle.

(14) In the water-blocking method described in any one of (8) to (13), the plurality of water-blocking nozzles may be flat spray nozzles.

Effects of the Invention

According to the aspects, when the hot-rolled steel sheet after finish rolling of the hot-rolling process is cooled by a large amount of the cooling water, the cooling water can be appropriately blocked.

EMBODIMENTS OF THE INVENTION

Figure 1:
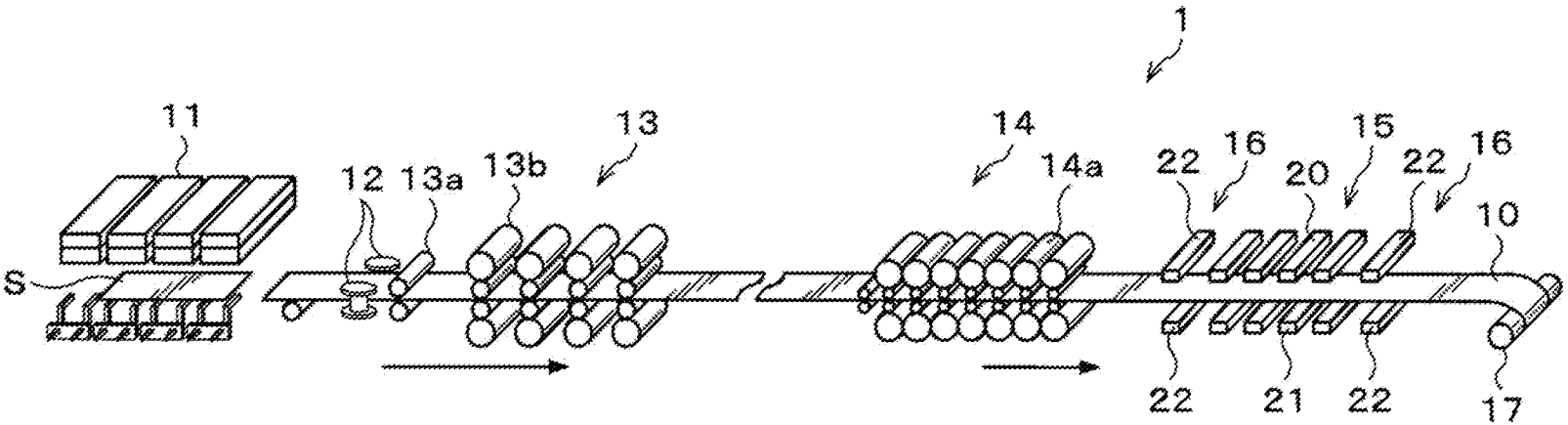
FIG. 1 is an explanatory view illustrating a schematic configuration of a hot rolling facility having a water-blocking apparatus according to an embodiment of the present invention.

Hereinafter, an embodiment of the present invention will be described. FIG. 1 is an explanatory view illustrating a schematic configuration of a hot rolling facility 1 having a water-blocking apparatus according to this embodiment.

In the hot rolling facility 1, a heated slab S is vertically interposed between rolls, is continuously rolled to be thinned to, for example, a sheet thickness of 1 mm, and is coiled as a hot-rolled steel sheet 10. The hot rolling facility 1 includes: a heating furnace 11 for heating the slab S; a width-direction rolling mill 12 which rolls the slab S heated by the heating furnace 11 in a width direction; a roughing mill 13 which vertically rolls the slab S rolled in the width direction to make a rough bar; a finishing mill 14 which continuously performs hot finish rolling on the rough bar further to a predetermined thickness; a cooling apparatus 15 which cools the hot-rolled steel sheet 10 subjected to the hot finish rolling by the finishing mill 14 with cooling water; a water-blocking apparatus 16 which blocks the cooling water sprayed from the cooling apparatus 15; and a coiler 17 which coils the hot-rolled steel sheet 10 cooled by the cooling apparatus 15 in a coil shape.

In the heating furnace 11, a side burner, an axial flow burner, and a roof burner are arranged to heat the slab S by blowing flames toward the slab S carried from the outside via a charging port. The slab S carried into the heating furnace 11 is sequentially heated by heating zones formed in corresponding zones, and the slab S is further uniformly heated by the roof burner in a soaking zone formed in a final zone for heat retaining treatment so as to be transported at an optimum temperature. When all heat treatment in the heating furnace 11 are ended, the slab S is transported to the outside of the heating furnace 11 to be transited to a rolling process by the roughing mill 13.

The roughing mill 13 allows the transported slab S to pass through a gap between columnar rotating rolls arranged over a plurality of stands. For example, in the roughing mill 13, hot rolling is performed on the slab S only by work rolls 13*a* vertically arranged in the first stand to be made into a rough bar. Next, the rough bar that passes through the work rolls 13*a* is further continuously rolled by a plurality of four-high mills 13*b* constituted by work rolls and back-up rolls. As a result, at the time of ending the rough-rolling process, the rough bar is rolled to a sheet thickness of about 30 to 60 mm and is transported to the finishing mill 14.

The finishing mill 14 performs finish rolling on the transported rough bar to a sheet thickness of several millimeters. The finishing mill 14 allows the rough bar to pass through a gap between finishing rolls 14*a* that are vertically lined up in a straight line over six to seven stands so that the rough bar is gradually rolled. The hot-rolled steel sheet 10 subjected to the finish rolling by the finishing mill 14 is transported by transporting rolls 18, which will be described later, to be sent to the cooling apparatus 15.

The configurations of the cooling apparatus 15 and the water-blocking apparatus 16 will be described later in detail.

The coiler 17 coils the hot-rolled steel sheet 10 cooled by the cooling apparatus 15 at a predetermined coiling temperature. The hot-rolled steel sheet 10 coiled by the coiler 17 in a coil shape is transported to the outside of the hot rolling facility 1.

Figure 2:
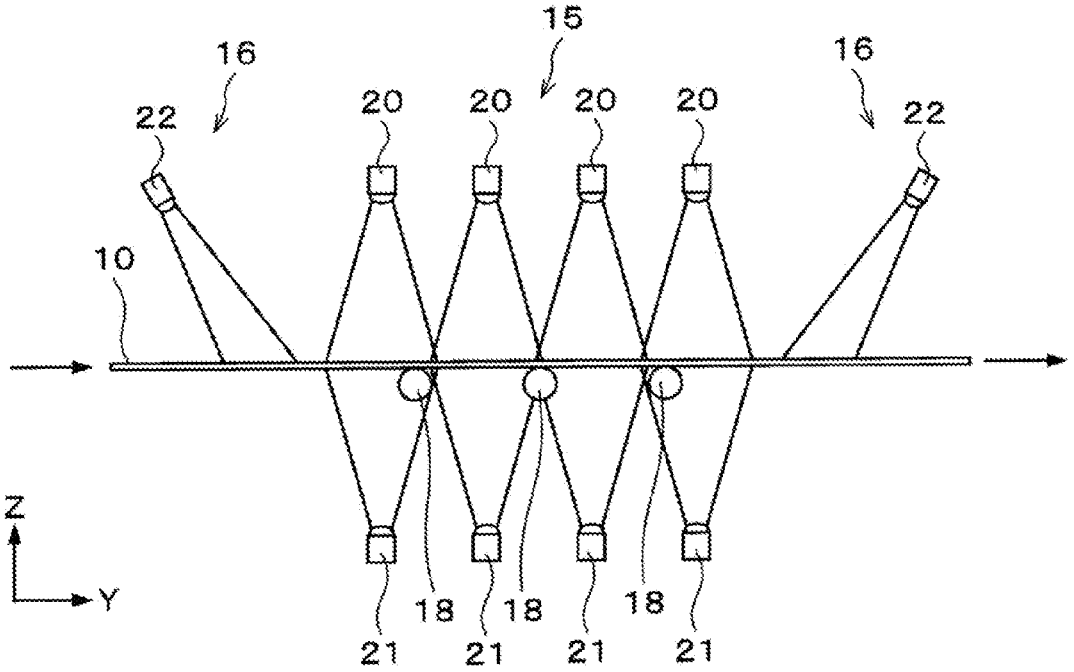
FIG. 2 is a side view illustrating schematic configurations of a cooling apparatus and the water-blocking apparatus.

Next, the configuration of the above-mentioned cooling apparatus 15 will be described. As illustrated in FIG. 2, the cooling apparatus 15 includes a plurality of cooling water nozzles 20 which spray the cooling water onto the surface of the hot-rolled steel sheet 10 from above the hot-rolled steel sheet 10 transported on the transporting rolls 18 of a run-out table. As the cooling water nozzle 20, for example, a full cone spray nozzle is used.

Figure 3:
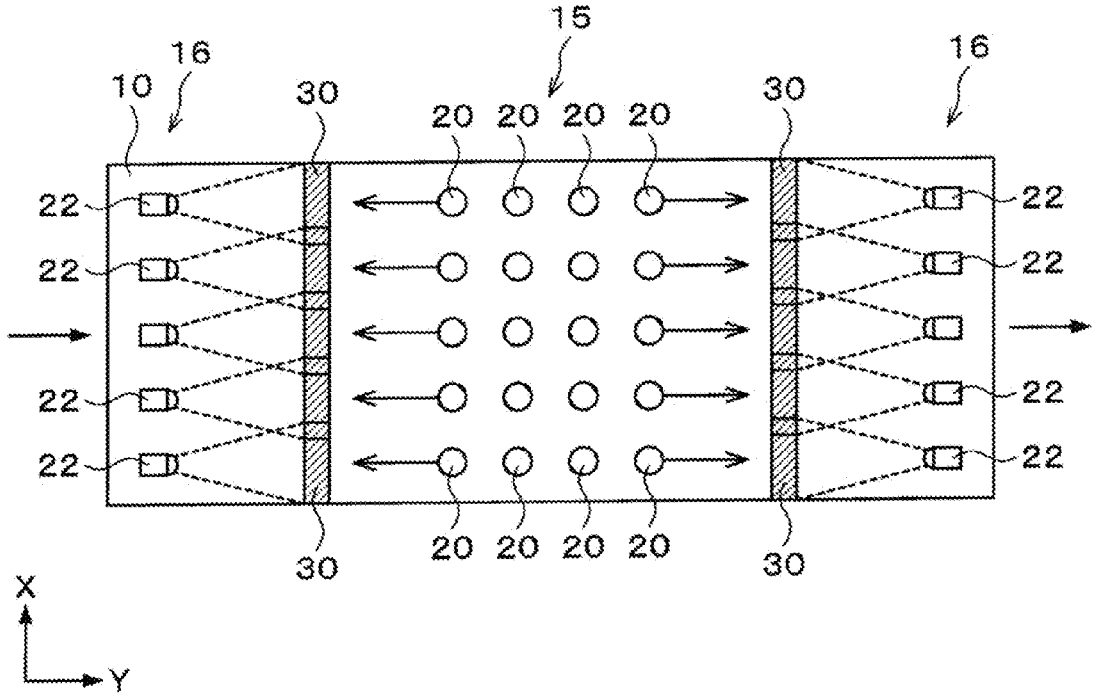
FIG. 3 is a plan view illustrating the schematic configurations of the cooling apparatus and the water-blocking apparatus.

As illustrated in FIG. 3, a plurality of, for example, five cooling water nozzles 20 are arranged in the width direction (X direction in the figure) of the hot-rolled steel sheet 10 and a plurality of, for example, four cooling water nozzles 20 are arranged in the sheet-threading direction (Y direction in the figure) of the hot-rolled steel sheet 10. In addition, the cooling water nozzles 20 in this embodiment spray the cooling water on the hot-rolled steel sheet 10 at a high sprayed water density of higher than 4 $m^3/m^2/min$ and equal to or less than 10 $m^3/m^2/min$ to cool the hot-rolled steel sheet 10 to a predetermined temperature.

In addition, as illustrated in FIG. 2, the cooling apparatus 15 includes a plurality of the other cooling water nozzles 21 which spray the cooling water onto, for example, the back surface of the hot-rolled steel sheet 10 from below the hot-rolled steel sheet 10. As the other cooling water nozzle 21, for example, a full cone spray nozzle is used. In addition, the arrangement of the other cooling water nozzles 21 is the same as that of the cooling water nozzles 20 described above.

In addition, as the cooling water nozzles 20 and 21, nozzles other than the spray nozzles of this embodiment, for example, various nozzles such as pipe laminar nozzles may be used. For example, when the pipe laminar nozzles are used as the cooling nozzles 20, the cooling water is sprayed from the cooling nozzles 20 in the vertical direction, and thus a spray angle $\theta_B$ with respect to the vertical direction of the cooling water sprayed from the cooling water nozzle 20, which will be described later, is 0°.

Next, the configuration of the above-mentioned water-blocking apparatus 16 will be described. The water-blocking apparatus 16 includes water-blocking nozzles 22 above the hot-rolled steel sheet 10, which spray water-blocking water onto the surface of the hot-rolled steel sheet 10 on each of the upstream side and the downstream side of the cooling water nozzles 20. As the water-blocking nozzle 22, for example, a flat spray nozzle is used. In addition, as illustrated in FIG. 3, the water-blocking nozzles 22 on the upstream side block the cooling water that flows toward the upstream side from the cooling water nozzles 20 using the water-blocking water sprayed from the corresponding water-blocking nozzles 22. Similarly, the water-blocking nozzles 22 on the downstream side block the cooling water that flows toward the downstream side from the cooling water nozzles 20 using the water-blocking water sprayed from the corresponding water-blocking nozzles 22.

Next, the arrangement of the water-blocking nozzles 22 for the above-described cooling water nozzles 20 and the action of the water-blocking water for the cooling water will be described. In addition, the arrangement of the water-blocking nozzles 22 and the action of the water-blocking water for the cooling water are the same on the upstream side and the downstream side.

As illustrated in FIG. 3, a plurality of, for example, five water-blocking nozzles 22 are lined up and arranged in the width direction of the hot-rolled steel sheet 10. The plurality of water-blocking nozzles 22 are arranged so that impact areas 30 of sprays of the water-blocking water that are sprayed from the water-blocking nozzles 22 and impact on the surface of the hot-rolled steel sheet 10 are continuously lined up in a straight line in the width direction of the hot-rolled steel sheet 10 in a plan view and adjacent impact areas 30 partially overlap. For example, in the width direction of the hot-rolled steel sheet 10, when a gap is present between the adjacent impact areas of the water-blocking water, there is a possibility that the cooling water (water on the sheet) leaks from the gap. For this, in this embodiment, in the width direction of the hot-rolled steel sheet 10, the impact areas of the water-blocking water are present without gaps, and thus the cooling water does not leak. In addition, the water-blocking nozzles 22 are arranged so that the spray angle of the water-blocking water is inclined toward the cooling water nozzle 20.

Figure 4:
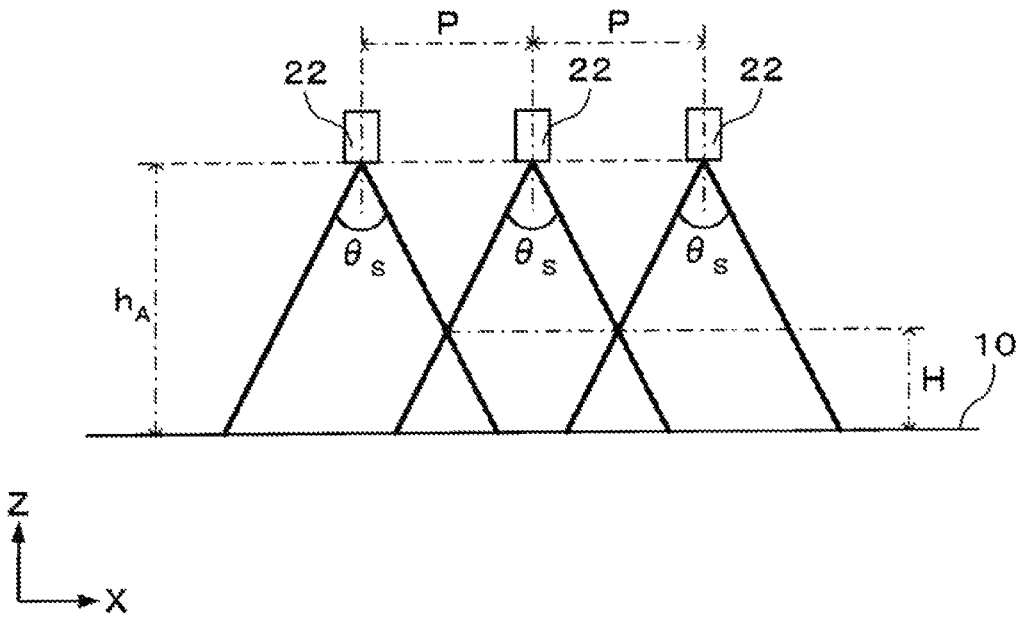
FIG. 4 is an explanatory view schematically illustrating the arrangement of water-blocking nozzles in a side view from a sheet-threading direction of a hot-rolled steel sheet.

FIG. 4 schematically illustrates the arrangement of the water-blocking nozzles 22 in a side view from the sheet-threading direction of the hot-rolled steel sheet 10. As illustrated in FIG. 4, an interval P between the adjacent water-blocking nozzles 22 and 22 in the width direction of the hot-rolled steel sheet 10 is set so that a height H at which sprays of the water-blocking water adjacent to each other in the width direction of the hot-rolled steel sheet 10 join is higher than 400 mm from the surface of the hot-rolled steel sheet 10.

That is, the water-blocking water is present without gaps in the vertical direction to the height H which is higher than 400 mm from the surface of the hot-rolled steel sheet 10. According to the verification by the inventors, it was proved that even in a case where the hot-rolled steel sheet 10 is cooled by a large amount of the cooling water, the height of the cooling water is lower than 400 mm from the surface of the hot-rolled steel sheet 10. Therefore, by satisfying the condition in which the height at which the adjacent sprays of the water-blocking water join is higher than 400 mm from the surface of the hot-rolled steel sheet 10, the cooling water does not overflow the water-blocking water and leak. Particularly, as in this embodiment, in the case where the cooling water having a high sprayed water density is sprayed onto the hot-rolled steel sheet 10, the cooling water is scattered vertically upward from the surface of the hot-rolled steel sheet 10. Therefore, it is preferable that the height condition of the water-blocking water be satisfied.

In addition, the height H at which the sprays of the water-blocking water join is geometrically calculated by the following Expression (3). In addition, so as to allow the height H at which the sprays of the water-blocking water join to be higher than 400 mm from the surface of the hot-rolled steel sheet 10, the interval P between the water-blocking nozzles 22 and 22, the angle $\theta_A$ of attack of the water-blocking water, and the spray angle $\theta_S$ of the water-blocking water are set in the following Expression (3). In addition, the height H at which the sprays of the water-blocking water join is naturally less than a height $h_A$ of the water-blocking nozzle 22 from the surface of the hot-rolled steel sheet 10, and the upper limit of the height H is substantially 900 mm.

$$H=\{h_A/\cos\theta_A\times\tan(\theta_S/2)-P/2\}\times\cos\theta_A/\tan(\theta_S/2) \quad (3)$$

Here, in the Expression (3), $h_A$ is the height (about 1000 mm) of the water-blocking nozzle 22 from the surface of the hot-rolled steel sheet 10, $\theta_A$ is the spray angle (hereinafter, may be called the angle of attack) of the water-blocking water sprayed from the water-blocking nozzle 22 with respect to the vertical direction, $\theta_S$ is the spray angle of the water-blocking water from the water-blocking nozzle 22, and P is the interval between the water-blocking nozzles 22 and 22 in the width direction of the hot-rolled steel sheet 10.

The spray angle $\theta_S$ of the water-blocking water is, for example, 5° to 150°. The spray angle $\theta_S$ of the water-blocking water is preferably 10° to 130°, and more preferably, 20 to 60°.

When the spray angle $\theta_S$ of the water-blocking water is too small, the nozzle pitch is reduced to ensure the height for blocking the cooling water, and the number of nozzles is increased, which results in poor economic efficiency. In contrast, when the spray angle $\theta_S$ of the water-blocking water is too large, the nozzle pitch is increased, and the number of nozzles is reduced, which results in good economic efficiency. However, the amount of water-blocking water in a direction pushing back the cooling water is reduced, and thus the function to block the cooling water is degraded. Therefore, the spray angle $\theta_S$ of the water-blocking water is, realistically, 5 to 150°.

In addition, in a case where the spray angle $\theta_S$ of the water-blocking water is 10 to 130°, water-blocking characteristics are enhanced, which is preferable.

Furthermore, the spray angle $\theta_S$ of the water-blocking water is more preferably 20 to 60°. For this reason, by increasing the number of nozzles to set the spray angle $\theta_S$ to be small, the amount of water-blocking water in a direction pushing back the cooling water is easily ensured, and thus the size of a feedwater system (pipes or the capacity of pumps, and the like) can be reduced, which results in high economic efficiency.

Figure 5:
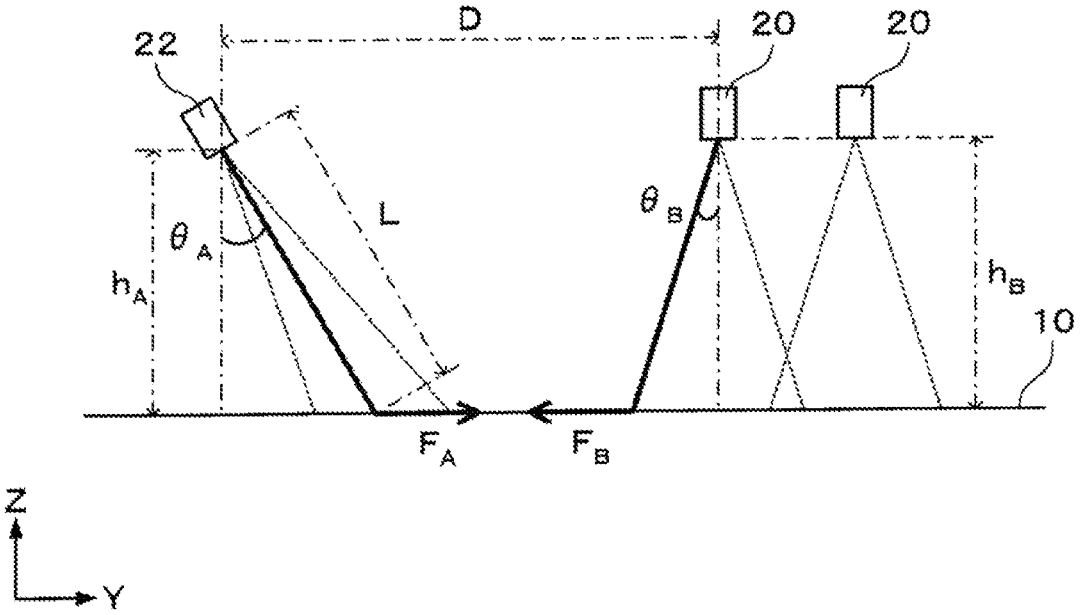
FIG. 5 is an explanatory view schematically illustrating the arrangement of the water-blocking nozzles with respect to cooling water nozzles in a side view from a width direction of the hot-rolled steel sheet.

FIG. 5 schematically illustrates the arrangement of the water-blocking nozzles 22 with respect to the cooling water nozzles 20 in a side view from the width direction of the hot-rolled steel sheet 10. As illustrated in FIG. 5, the water-blocking nozzle 22 is disposed at such a position that a distance L between the water-blocking nozzle 22 and the surface of the hot-rolled steel sheet 10 in a spraying direction of the water-blocking water from the water-blocking nozzle 22 is 2000 mm or less. According to the verification by the inventors, it was proved that in a case where the distance L between the water-blocking nozzle 22 and the surface of the hot-rolled steel sheet 10 in the spraying direction of the water-blocking water exceeds 2000 mm, the water-blocking water sprayed from the water-blocking nozzle 22 onto the hot-rolled steel sheet 10 is damped by air resistance, the momentum of the water-blocking water is reduced, and there is a possibility that a large amount of the cooling water may not be appropriately blocked. Therefore, as described above, it is preferable that the distance L between the water-blocking nozzle 22 and the surface of the hot-rolled steel sheet 10 in the spraying direction of the water-blocking water be set to be 2000 mm or less.

In addition, when the plurality of water-blocking nozzles 22 are arranged at positions close to the cooling water nozzles 20, the occupancy area of the hot rolling facility 1 can be reduced. However, the water-blocking nozzles 22 are arranged at such positions that the water-blocking water sprayed from the water-blocking nozzles 22 and the cooling water sprayed from the cooling water nozzles 20 do not impact on each other before reaching the hot-rolled steel sheet 10. That is, the water-blocking nozzle 22 is disposed at a position at which a distance D between the water-blocking nozzle 22 and the cooling water nozzle 20 satisfies the following Expression (4).

$$D\geq(h_A\times\tan\theta_A+h_B\times\tan\theta_B) \quad (4)$$

Here, in the Expression (4), $h_A$ is the height of the water-blocking nozzle 22 from the surface of the hot-rolled steel sheet 10, $\theta_A$ is the angle of attack of the water-blocking water sprayed from the water-blocking nozzle 22 with respect to the vertical direction, $h_B$ is the height of the cooling water nozzle 20 from the surface of the hot-rolled steel sheet 10, and $\theta_B$ is the spray angle of the cooling water sprayed from the cooling water nozzle 20 with respect to the vertical direction.

The water-blocking water sprayed from the water-blocking nozzle 22 is sprayed so that a momentum $F_A$ of the water-blocking water that flows toward the cooling water nozzle 20 on the surface of the hot-rolled steel sheet 10 in the sheet-threading direction of the hot-rolled steel sheet 10 is 1.0 to 1.5 times the momentum $F_B$ of the cooling water that flows toward the water-blocking nozzle 22 in the sheet-threading direction of the hot-rolled steel sheet 10.

The momentum $F_A$ of the water-blocking water is defined by, for example, the following Expression (1) from a density ρ of water, an amount $Q_A$ of the water-blocking water sprayed from the water-blocking nozzle 22, a flow velocity $v_A$ of the water-blocking water sprayed from the water-blocking nozzle 22, and the spray angle $\theta_A$ of the water-blocking water sprayed from the water-blocking nozzle 22 with respect to the vertical direction.

In addition, the momentum $F_B$ of the cooling water is defined by, for example, the following Expression (2) from the density ρ of water, an amount $Q_B$ of the cooling water sprayed from a row of the cooling water nozzles 20 arranged in the width direction of the hot-rolled steel sheet 10, a flow velocity $v_B$ of the cooling water sprayed from the cooling water nozzles 20, and the spray angle $\theta_B$ of the cooling water sprayed from the cooling water nozzles 20 with respect to the vertical direction.

$$F_A=\rho\cdot Q_A\cdot v_A\cdot(1+\sin\theta_A)/2 \quad (1)$$

$$F_B=\rho\cdot Q_B\cdot v_B\cdot(1+\sin\theta_B)/2 \quad (2)$$

Hereinafter, a method of deriving the above Expression (1) is described. In addition, a method of deriving the above Expression (2) is the same as the method of deriving the above Expression (1).

Figure 6:
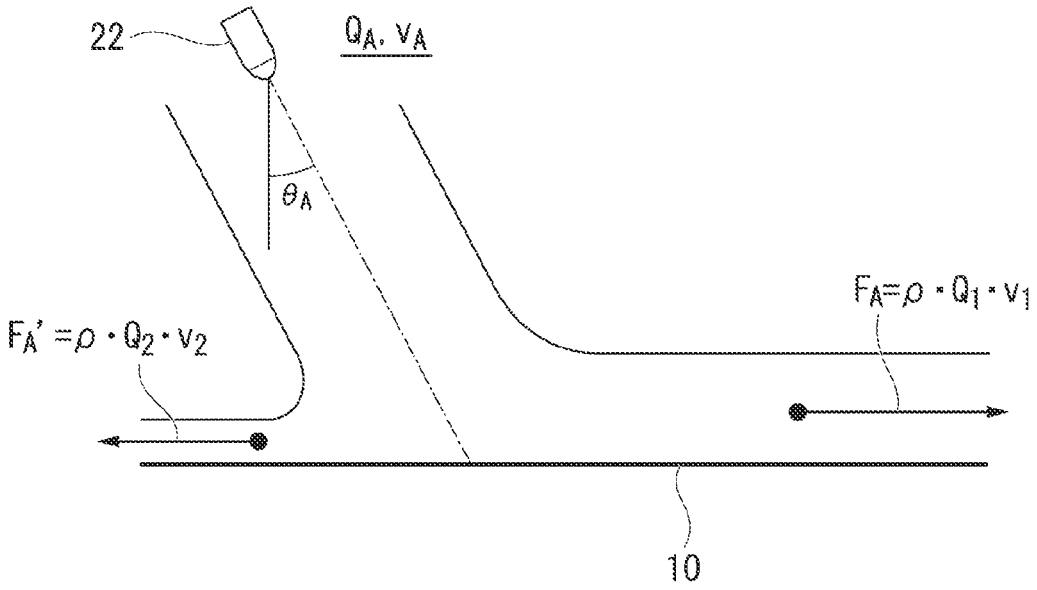
FIG. 6 is an explanatory view of a method of deriving Expression (1) that expresses a momentum $F_A$ of water-blocking water and Expression (2) that expresses a momentum $F_B$ of cooling water.

As illustrated in FIG. 6, it is assumed that the amount of the water-blocking water sprayed from the water-blocking nozzle 22 is $Q_A$, the flow velocity of the water-blocking water sprayed from the water-blocking nozzle 22 is $v_A$, the spray angle of the water-blocking water sprayed from the water-blocking nozzle 22 with respect to the vertical direction is $\theta_A$, and the density of water is $\rho$. Here, the momentum $F_A$ of the water-blocking water that flows toward the cooling water nozzle 20 along the surface of the hot-rolled steel sheet 10 after impacting on the surface of the hot-rolled steel sheet 10 is defined by the following Expression (5).

In addition, a momentum $F_A'$ of the water-blocking water that flows in the opposite direction to the cooling water nozzle 20 along the surface of the hot-rolled steel sheet 10 after impacting on the surface of the hot-rolled steel sheet 10 is defined by the following Expression (6).

$$F_A=\rho\cdot Q_1\cdot v_1 \tag{5}$$

$$F_A'=\rho\cdot Q_2\cdot v_2 \tag{6}$$

Here, in the above Expression (5), $Q_1$ is the amount of the water-blocking water that flows toward the cooling water nozzle 20 along the surface of the hot-rolled steel sheet 10, and $v_1$ is the flow velocity of the water-blocking water that flows toward the cooling water nozzle 20 along the surface of the hot-rolled steel sheet 10.

In addition, in the above Expression (6), $Q_2$ is the amount of the water-blocking water that flows in the opposite direction to the cooling water nozzle 20 along the surface of the hot-rolled steel sheet 10, and $v_2$ is the flow velocity of the water-blocking water that flows in the opposite direction to the cooling water nozzle 20 along the surface of the hot-rolled steel sheet 10.

When it is assumed that there is no loss such as friction before and after the water-blocking water impacts on the hot-rolled steel sheet 10, the following Expression (7) is established on the basis of the conservation of momentum in a fluid.

$$\rho\cdot Q_A\cdot v_A\cdot\sin\theta\theta_A=\rho\cdot Q_1\cdot v_1\cdot\rho\cdot Q_2\cdot v_2 \tag{7}$$

Here, when it is thought that the following Expression (8) is established from the assumption that there is no loss before and after the water-blocking water impacts on the hot-rolled steel sheet 10, the above Expression (7) can be expressed as the following Expression (9).

$$v_A=v_1=v_2 \tag{8}$$

$$Q_A\cdot\sin\theta_A=Q_1-Q_2 \tag{9}$$

Regarding the amounts $Q_A$, $Q_1$, and $Q_2$ of the water-blocking water, the following Expression (10) is established. Therefore, on the basis of the above Expression (9) and the following Expression (10), the amount $Q_1$ of the water-blocking water is expressed by the following Expression (11), and the amount $Q_2$ of the water-blocking water is expressed by the following Expression (12).

$$Q_A=Q_1+Q_2 \tag{10}$$

$$Q_1=Q_A\cdot(1+\sin\theta_A)/2 \tag{11}$$

$$Q_2=Q_A\cdot(1-\sin\theta_A)/2 \tag{12}$$

From the above Expressions (5), (8), and (11), finally, the following Expression (1) which expresses the momentum $F_A$ of the water-blocking water (that is, the water-blocking water that flows toward the cooling water nozzle 20 along the surface of the hot-rolled steel sheet 10) is derived.

$$F_A=\rho\cdot Q_A\cdot v_A\cdot(1+\sin\theta_A)/2 \tag{1}$$

In addition, as can be seen from the method of deriving the above-described Expression (1), the momentum $F_B$ of the cooling water expressed by Expression (2) is the momentum of the cooling water that flows toward the water-blocking nozzle 22 along the surface of the hot-rolled steel sheet 10 (see FIG. 5).

In this embodiment, on the basis of the above Expressions (1) and (2), various device parameters (the variables in the above Expressions (1) and (2)) are set so that the momentum $F_A$ of the water-blocking water is 1.0 to 1.5 times the momentum $F_B$ of the cooling water. The momentum $F_A$ of the water-blocking water and the momentum $F_B$ of the cooling water are vector quantities directed in a direction in which the water-blocking water and the cooling water impact on each other on the surface of the hot-rolled steel sheet 10.

In addition, in the above Expressions (1) and (2), it is assumed that the amount $Q_A$ of the water-blocking water and the amount $Q_B$ of the cooling water sprayed from the water-blocking nozzle 22 and the cooling water nozzle 20 are constant until the water-blocking water and the cooling water reach the surface of the hot-rolled steel sheet 10 immediately after being sprayed from the water-blocking nozzle 22 and the cooling water nozzle 20, respectively. In addition, it is assumed that the spray angle $\theta_B$ of the cooling water sprayed from the cooling water nozzle 20 is an angle with respect to the vertical direction, and it is assumed that the amount $Q_B$ of the cooling water sprayed from the cooling water nozzle 20 entirely flows toward any one of the upstream side and the downstream side on the surface of the hot-rolled steel sheet 10.

Therefore, in the case where the amount $Q_B$ of the cooling water is considered, the amount of water on the most dangerous side (the safest side from the viewpoint of blocking the cooling water) is considered, and thus the momentum $F_B$ of the cooling water is maximized. In addition, in the case where the amount $Q_B$ of the cooling water is considered, the cooling water only from the cooling water nozzles 20 on the most upstream side or the most downstream side, that is, only a row of the cooling water nozzles 20 closest to the water-blocking nozzle 22 is considered, and the cooling water from the other cooling water nozzles 20 is not considered. In addition, the flows of the cooling water from the other cooling water nozzles 20 in the sheet-threading direction of the hot-rolled steel sheet 10 cancel each other, and thus the corresponding cooling water flows in the width direction of the hot-rolled steel sheet 10.

In this embodiment, on the surface of the hot-rolled steel sheet 10, since the momentum $F_A$ of the water-blocking water that flows in the sheet-threading direction of the hot-rolled steel sheet 10 is equal to or greater than the momentum $F_B$ of the cooling water, the water-blocking water can block the cooling water, and thus the cooling water does not pass through the water-blocking water and leak. In contrast, according to the verification by the inventors, it was proved that when the momentum $F_A$ of the water-blocking water is greater than 1.5 times the momentum $F_B$ of the cooling water, the water-blocking water submerges below the cooling water, and the cooling ability of the cooling water to cool the hot-rolled steel sheet 10 is degraded. Therefore, as in this embodiment, it is preferable that the momentum $F_A$ of the water-blocking water be set to 1.0 to 1.5 times the momentum $F_B$ of the cooling water.

In addition, the angle $\theta_A$ of attack of the water-blocking water sprayed from the water-blocking nozzle 22 with respect to the vertical direction is 20 to 65 degrees, and more preferably, 30 to 50 degrees. For example, when the angle $\theta_A$ of attack is smaller than 20 degrees, there is concern that the water-blocking water sprayed from the water-blocking nozzle 22 may flow in the opposite direction to the cooling water. In this case, there is a possibility that the cooling water may not be appropriately blocked by the water-blocking water. In addition, for example, when the angle $\theta_A$ of attack is greater than 65 degrees, the distance between the water-blocking nozzle 22 and the impact area 30 is increased, and thus the occupancy area of the hot rolling facility 1 is increased. Therefore, it is preferable that the angle $\theta_A$ of attack be 20 to 65 degrees.

As described above, in this embodiment, the arrangement of the water-blocking nozzles 22 and the spray angle of the water-blocking water are set so that the impact areas 30 of the water-blocking water respectively sprayed from the water-blocking nozzles 22 are continuously lined up in a straight line on the surface of the hot-rolled steel sheet 10 in the width direction of the hot-rolled steel sheet 10 and the adjacent impact areas 30 partially overlap.

In addition, in this embodiment, the plurality of water-blocking nozzles 22 are lined up and arranged in the width direction of the hot-rolled steel sheet 10 so that the distance L between each of the water-blocking nozzles 22 and the surface of the hot-rolled steel sheet 10 in the spraying direction of the water-blocking water is 2000 mm or less.

In addition, in this embodiment, the height H at which the sprays of the water-blocking water which are adjacent to each other in the width direction of the hot-rolled steel sheet 10 join is set to be higher than 400 mm from the surface of the hot-rolled steel sheet 10 in the side view as viewed from the sheet-threading direction of the hot-rolled steel sheet 10.

Moreover, in this embodiment, the momentum $F_A$ of the water-blocking water that flows in the sheet-threading direction of the hot-rolled steel sheet 10 (toward the cooling water nozzle) on the surface of the hot-rolled steel sheet 10 is set to be 1.0 to 1.5 times the momentum $F_B$ of the cooling water that flows in the sheet-threading direction of the hot-rolled steel sheet 10 (toward the water-blocking nozzle).

Therefore, according to this embodiment, even in the case where the hot-rolled steel sheet 10 is cooled by the cooling water having a high sprayed water density of higher than 4 $m^3/m^2/min$ and equal to or less than 10 $m^3/m^2/min$, the cooling water can be appropriately blocked while appropriately cooling the hot-rolled steel sheet 10 with the cooling water. In addition, the effect of each condition is as described above.

In addition, since the cooling water is appropriately blocked by the water-blocking water from the water-blocking nozzle 22 as described above, the cooling water does not overflow the cooling area of the cooling apparatus 15 and leak. Therefore, the hot-rolled steel sheet 10 can be uniformly cooled to a predetermined temperature by using the cooling apparatus 15. In addition, since the hot-rolled steel sheet 10 is cooled by the cooling water having a high sprayed water density of higher than 4 $m^3/m^2/min$ and equal to or less than 10 $m^3/m^2/min$, the hot-rolled steel sheet 10 can be appropriately cooled with a high cooling ability.

In addition, the present invention is not limited to the above-described embodiment, and can employ the following modified examples.

(1) In the above-described embodiment, the water-blocking nozzles 22 are provided on both sides including the upstream side and the downstream side of the cooling water nozzles 20. However, for example, instead of the water-blocking nozzles 22 on any one of the sides, restraining rolls, side sprays, or the like may be used.

(2) In the above-described embodiment, the case where the plurality of water-blocking nozzles 22 are lined up and arranged in the width direction of the hot-rolled steel sheet 10 is exemplified. However, for example, as illustrated in FIGS. 7A and 7B, in a plan view, the plurality of water-blocking nozzles 22 may be lined up and arranged in a direction inclined with respect to the width direction of the hot-rolled steel sheet 10.

Figure 7A:
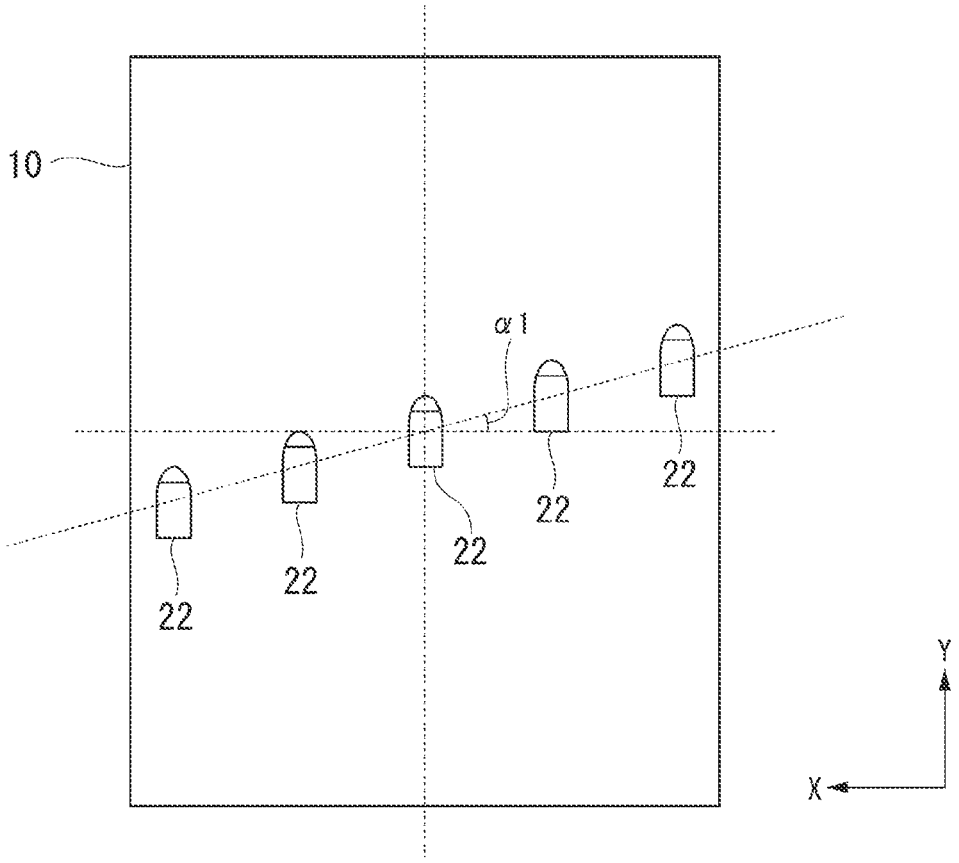
FIG. 7A is a diagram illustrating a modified example of the arrangement of the water-blocking nozzles.
Figure 7B:
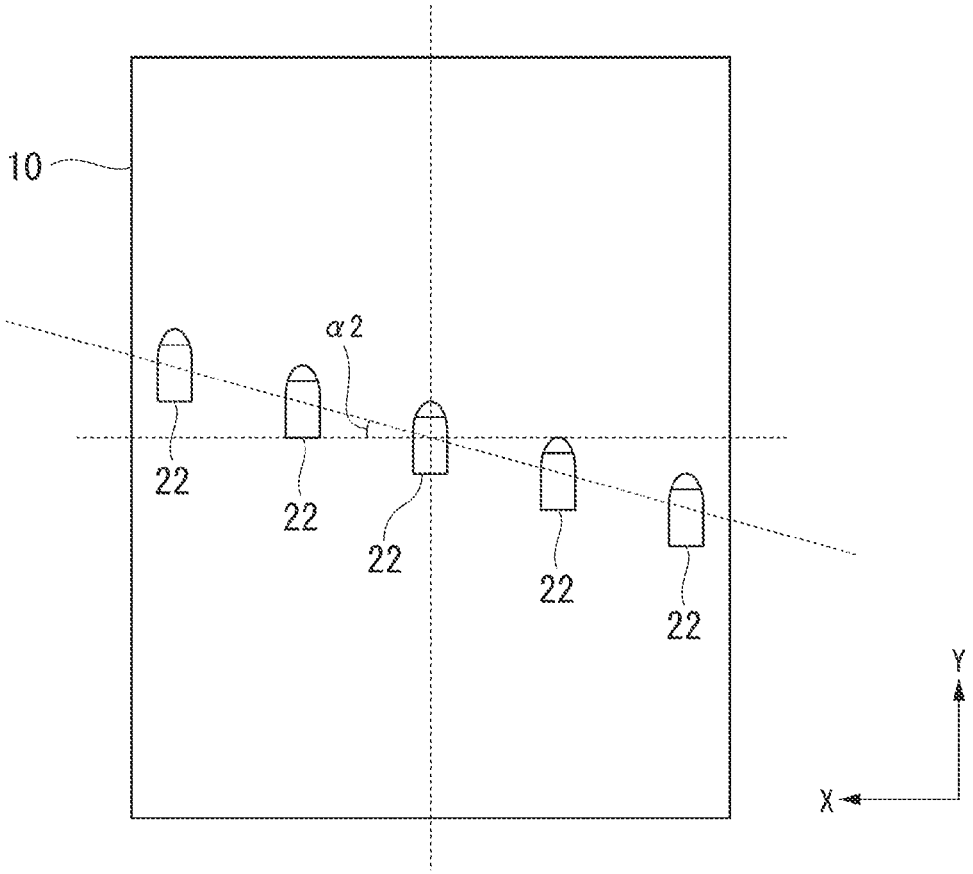
FIG. 7B is a diagram illustrating a modified example of the arrangement of the water-blocking nozzles.
Figure 8:
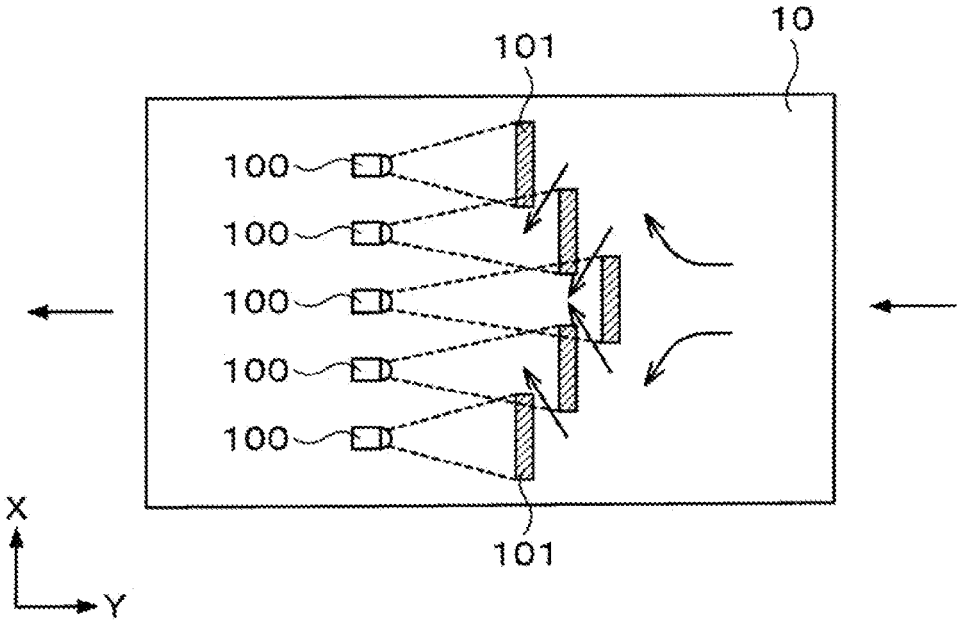
FIG. 8 is an explanatory view illustrating impact surfaces of flat spray nozzles and flows of water on a sheet in a plan view in a case where the water on the sheet caused by cooling water having a flow rate of 4 $m^3/m^2/min$ or less is blocked.

FIG. 7A illustrates a case where the plurality of water-blocking nozzles 22 are lined up and arranged in a direction inclined counterclockwise at an angle of $\alpha$1 with respect to the width direction of the hot-rolled steel sheet 10. FIG. 7B illustrates a case where the plurality of water-blocking nozzles 22 are lined up and arranged in a direction inclined clockwise at an angle of $\alpha$2 with respect to the width direction of the hot-rolled steel sheet 10.

It is preferable that both the angles $\alpha 1$ and $\alpha 2$ be 0° or higher and 30° or less. When the angles $\alpha 1$ and $\alpha 2$ exceed 30°, the pipe length and the number of nozzles is increased and thus the facility size is increased, which results in poor economic efficiency. In addition, when the angles $\alpha 1$ and $\alpha 2$ exceed 30°, there is a possibility of a problem of a temperature difference between a work side and a drive side in the steel sheet.

(3) Although not particularly mentioned in the above-described embodiment, the water-blocking nozzles 22 may be arranged so that the water-blocking water directly abuts on the table rolls. In a case where the water-blocking water is sprayed onto an intermediate position between the adjacent table rolls, there is a need to consider that sheet-threading characteristics of the tip end portion of the steel sheet should not be harmed. For example, there is a need to reduce the amount of the water-blocking water, the pressure thereof, and the like only during the passage of the tip end portion of the steel sheet or to spray the water-blocking water after the passage of the tip end portion of the steel sheet. Therefore, it is preferable that the water-blocking nozzles 22 be arranged to cause the water-blocking water to directly abut on the table rolls.

(4) in addition, in the above-described embodiment, the flat spray nozzles 22 are used as the water-blocking nozzle 22. However, other nozzles may also be used as long as all the conditions in the above-described embodiment are satisfied. That is, as long as the impact areas 30 of the sprays of the water-blocking water on the surface of the hot-rolled steel sheet 10 are continuously lined up in a straight line in the width direction of the hot-rolled steel sheet 10 in a plan view, the height H at which the sprays of the water-blocking water which are adjacent to each other in the width direction of the hot-rolled steel sheet 10 join is higher than 400 mm from the surface of the hot-rolled steel sheet 10, and the cooling water is sprayed so that the momentum $F_A$ of the water-blocking water that flows in the sheet-threading direction of the hot-rolled steel sheet 10 on the surface of the hot-rolled steel sheet 10 is equal to or greater than the momentum $F_B$ of the cooling water, other nozzles, for example, full cone spray nozzles or the like may be used as the water-blocking nozzles 22.

However, it is not preferable to use a full width slit nozzle (a nozzle in which its fluid spray hole extends over the entire width direction of the hot-rolled steel sheet) as the water-blocking nozzle 22. Generally, a full width slit nozzle for hot rolling is used for a low pressure and a large flow rate. A full width slit nozzle for a high pressure and a high flow rate results in a very high water amount and is thus used only for a special process. The reason is that the fluid spray hole (slit) of the full width slit nozzle extends over the entire width direction of the hot-rolled steel sheet and thus the thickness of the slit needs to be small in order to achieve the same degree of spray width as that of a spray nozzle.

For example, in a case where eight flat nozzles having fluid spray holes with a diameter of 14 mm are lined up, the thickness of the slit is 0.6 mm when the slit has a width of 2 mm, and thus the slit becomes clogged very easily. When the thickness is set to, for example, about 3 mm, the flow velocity is reduced to ⅕ and thus a reduction in the flow velocity becomes significant. Therefore, it is difficult to arrange the conditions only by the ratios of the momentums of the water-blocking water and the cooling water. For example, a problem in drainage characteristics occurs due to a very high amount of the water-blocking water. For the above reasons, it is not preferable to use the width slit nozzle as the water-blocking nozzle 22.

While the appropriate embodiments and modified examples of the present invention have been described with reference to the accompanying drawings, the present invention is not limited to the embodiments and the modified examples. It is apparent that various changes and modifications can be conceived by those skilled in the art without departing from the scope of the gist described in the appended claims, and it is understood that the changes and modifications naturally belong to the technical scope of the present invention.

EXAMPLES

Hereinafter, verification results of an effect of blocking the cooling water in the case where the water-blocking apparatus and the water-blocking method of the present invention are used are described. For the verification of the effect of blocking the cooling water, the water-blocking apparatus 16 illustrated in FIGS. 1 to 5 was used as the water-blocking apparatus of the present invention.

As shown in Table 1, the effect of blocking the cooling water was verified by changing the amount (sprayed water density) $Q_B$ of the cooling water, the amount (sprayed water density) $Q_A$ of the water-blocking water, the spray angle $\theta_S$ of the water-blocking water, the angle $\theta_A$ of attack of the water-blocking water, and the interval (pitch) P between the water-blocking nozzles 22 and 22. In addition, regarding the amount $Q_B$ of the cooling water, the cooling water only from the cooling water nozzles 20 on the most upstream side or the most downstream side, that is, only the half of a row of the cooling water nozzles 20 closest to the water-blocking nozzle 22 is considered, and the cooling water from the other cooling water nozzles 20 is not considered. Moreover, in any of Examples 1 to 15 and Comparative Examples 1 to 29 shown in Table 1, the impact areas 30 of the sprays of the water-blocking water on the surface of the hot-rolled steel sheet 10 are continuously lined up in a straight line in the width direction of the hot-rolled steel sheet 10 in a plan view, and the adjacent impact areas 30 partially overlap.

In the "Cooling ability degradation" field in Table 1, the degree of cooling ability degradation is indicated by three levels of A, B, and C. A means that the ratio $F_A/F_B$ of the momentum $F_A$ of the water-blocking water and the momentum $F_B$ of the cooling water is less than 1.3 and it is determined that there is little cooling ability degradation (a degree of cooling power degradation of 0% or higher and less than 10%). B means that the ratio $F_A/F_B$ of the momentum $F_A$ of the water-blocking water and the momentum $F_B$ of the cooling water is 1.3 or higher and less than 1.5 and it is determined that there is a little cooling ability degradation (a degree of cooling ability degradation of 10% or higher and less than 30%). C means that the ratio $F_A/F_B$ of the momentum $F_A$ of the water-blocking water and the momentum $F_B$ of the cooling water is 1.5 or higher and it is determined that there is cooling ability degradation (a degree of cooling ability degradation of 30% or higher). Here, B and C are cases where blocking the cooling water is possible although the cooling ability of the cooling facility is not as designed, and in a case where blocking the cooling water has priority over examining the cooling ability of the main body of the cooling facility, the ratio $F_A/F_B$ of the momentums may be equal to or higher than 1.5. In addition, the ratio $F_A/F_B$ of the momentums is a reference, and the amount of cooling ability degraded is also affected by the water amount of the cooling facility and the nozzle distance.

In addition, in the "Water-blocking characteristics" field in Table 1, as a result of actual observation of water-blocking circumstances, "A" is written in a case where water-blocking is easily and appropriately performed, "B" is written in a case where water-blocking is appropriately performed, and "C" is written in a case where the cooling water overflows the water-blocking water and leaks.

Furthermore, in a case where "Cooling ability degradation" is "A" or "B" and "Water-blocking characteristics" is "A" or "A" is written in the "Evaluation" field in Table 1. On the other hand, in a case where "Cooling ability degradation" is "C" or "Water-blocking characteristics" is "C", "B" is written in the "Evaluation" field in Table 1. Therefore, when "A" is written in the "Evaluation" field, the effect of the present invention is proved.

In addition, regarding the verification of the effect of "Water-blocking characteristics", whether or not three conditions which are the conditions of the present invention are satisfied was verified:

(1) The momentum $F_A$ of the water-blocking water that flows in the sheet-threading direction of the hot-rolled steel sheet 10 is 1.0 to 1.5 times the momentum $F_B$ of the cooling water.

(2) The height H at which the sprays of the water-blocking water which are adjacent to each other in the width direction of the hot-rolled steel sheet 10 join is higher than 400 mm from the surface of the hot-rolled steel sheet 10.

(3) The distance L between the water-blocking nozzle 22 and the surface of the hot-rolled steel sheet 10 in the spraying direction of the water-blocking water from the water-blocking nozzle 22 is 2000 mm or less.

In Comparative Examples 1 to 11 in Table 1, the amount (sprayed water density) $Q_B$ of the cooling water is a low sprayed water density of 4 $m^3/m^2/min$ or less. In contrast, in Examples 1 to 5, Comparative Examples 12 to 17, Examples 6 to 10, Comparative Examples 18 to 23, Examples 11 to 15, and Comparative Examples 24 to 29 in Table 1, the amount (sprayed water density) $Q_B$ of the cooling water is a high sprayed water density of higher than 4 $m^3/m^2/min$ and equal to or less than 10 $m^3/m^2/min$.

First, Comparative Examples 1 to 11 in which the amount (sprayed water density) $Q_B$ of the cooling water is a low sprayed water density of 3.5 $m^3/m^2/min$ are examined.

In Comparative Examples 1 to 6, all the above conditions (1) to (3) were satisfied, and blocking the cooling water was appropriately performed. However, the momentum $F_A$ of the water-blocking water was equal to or higher than the momentum $F_B$ of the cooling water. In this case, since the hot-rolled steel sheet 10 was cooled by the cooling water having a low sprayed water density and the momentum $F_B$ of the cooling water was reduced, the water-blocking water had submerged below the cooling water and the cooling ability of the cooling water to cool the hot-rolled steel sheet 10 was degraded.

In addition, in Comparative Example 7, the conditions (2) and (3) were satisfied, the momentum $F_A$ of the water-blocking water was greater than 1.5 times the momentum $F_B$ of the cooling water, and thus water-blocking characteristics were good. However, since the momentum $F_A$ of the water-blocking water was too great, the water-blocking water had submerged below the cooling water and the cooling ability of the cooling water to cool the hot-rolled steel sheet 10 was degraded. Therefore, "Evaluation" of Comparative Examples 1 to 7 was "B".

In Comparative Examples 8 and 9, the momentum $F_A$ of the water-blocking water was equal to or higher than the momentum $F_B$ of the cooling water, and thus the cooling ability of the cooling water to cool the hot-rolled steel sheet 10 was degraded. Moreover, since any of the conditions (1) to (3) was not satisfied, blocking the cooling water was not appropriately performed. Therefore, "Evaluation" of Comparative Examples 8 and 9 was "B".

In Comparative Examples 10 and 11, the momentum $F_A$ of the water-blocking water was smaller than the momentum $F_B$ of the cooling water, and thus the cooling ability of the cooling water to cool the hot-rolled steel sheet 10 was not degraded. However, the condition (1) was not satisfied, and blocking the cooling water was not appropriately performed. Therefore, "Evaluation" of Comparative Examples 10 and 11 was "B".

As described above, in the case where the hot-rolled steel sheet 10 was cooled by the cooling water having a low sprayed water density, the cooling water could not be appropriately blocked while appropriately cooling the hot-rolled steel sheet 10 by the cooling water.

Next, Examples 1 to 5 and Comparative Examples 12 to 17 in which the amount (sprayed water density) $Q_B$ of the cooling water is a high sprayed water density of 4.2 $m^3/m^2/min$ are examined.

In Comparative Example 12, the conditions (2) and (3) were satisfied, the momentum $F_A$ of the water-blocking water was greater than 1.5 times the momentum $F_B$ of the cooling water, and thus water-blocking characteristics were good. However, since the momentum $F_A$ of the water-blocking water was too great, the water-blocking water had submerged below the cooling water and the cooling ability of the cooling water to cool the hot-rolled steel sheet 10 was degraded.

In Comparative Examples 13 and 15, the momentum $F_A$ of the water-blocking water was smaller than the momentum $F_B$ of the cooling water, and thus the cooling ability of the cooling water to cool the hot-rolled steel sheet 10 was not degraded. However, the condition (1) was not satisfied, and blocking the cooling water was not appropriately performed.

In Comparative Example 16, the condition (1) was satisfied, and the cooling ability of the cooling water to cool the hot-rolled steel sheet 10 was not degraded. However, the height H at which the adjacent sprays of the water-blocking water had joined was 400 mm or less and thus the condition (2) was not satisfied, and blocking the cooling water was not appropriately performed.

In Comparative Example 17, the distance L between the water-blocking nozzle 22 and the surface of the hot-rolled steel sheet 10 was greater than 2000 mm and thus the condition (3) was not satisfied, and blocking the cooling water was not appropriately performed. In addition, in this case, the water-blocking water had submerged below the cooling water and the cooling ability of the cooling water to cool the hot-rolled steel sheet 10 was degraded.

Contrary to this, in Examples 1 to 5, all the conditions (1) to (3) were satisfied, and thus the cooling water could be appropriately blocked while appropriately cooling the hot-rolled steel sheet 10 by the cooling water.

In the same manner, Examples 6 to 10 and Comparative Examples 18 to 23 in which the amount (sprayed water density) $Q_B$ of the cooling water is a high sprayed water density of 6.0 $m^3/m^2/min$ are examined.

In Comparative Example 18, the conditions (2) and (3) were satisfied, the momentum $F_A$ of the water-blocking water was greater than 1.5 times the momentum $F_B$ of the cooling water, and thus water-blocking characteristics were good. However, since the momentum $F_A$ of the water-blocking water was too great, the water-blocking water had submerged below the cooling water and the cooling ability of the cooling water to cool the hot-rolled steel sheet 10 was degraded.

In Comparative Examples 19 to 21, the momentum $F_A$ of the water-blocking water was smaller than the momentum $F_B$ of the cooling water, and thus the cooling ability of the cooling water to cool the hot-rolled steel sheet 10 was not degraded. However, the condition (1) was not satisfied, and blocking the cooling water was not appropriately performed.

In Comparative Example 22, the condition (1) was satisfied and the cooling ability of the cooling water to cool the hot-rolled steel sheet 10 was not degraded. However, the height H at which the adjacent sprays of the water-blocking water had joined was 400 mm or less and thus the condition (2) was not satisfied, and blocking the cooling water was not appropriately performed.

In Comparative Example 23, the distance L between the water-blocking nozzle 22 and the surface of the hot-rolled steel sheet 10 was greater than 2000 mm and thus the condition (3) was not satisfied, and blocking the cooling water was not appropriately performed. In addition, in this case, the water-blocking water had submerged below the cooling water and the cooling ability of the cooling water to cool the hot-rolled steel sheet 10 was degraded.

Contrary to this, in Examples 6 to 10, all the conditions (1) to (3) were satisfied, and thus the cooling water could be appropriately blocked while appropriately cooling the hot-rolled steel sheet 10 by the cooling water.

In the same manner, Examples 11 to 15 and Comparative Examples 24 to 29 in which the amount (sprayed water density) $Q_B$ of the cooling water is a high sprayed water density of 8.0 $m^3/m^2/min$ are examined.

In Comparative Example 24, the conditions (2) and (3) were satisfied, the momentum $F_A$ of the water-blocking water was greater than 1.5 times the momentum $F_B$ of the cooling water, and thus water-blocking characteristics were good. However, since the momentum $F_A$ of the water-blocking water was too great, the water-blocking water had submerged below the cooling water and the cooling ability of the cooling water to cool the hot-rolled steel sheet 10 was degraded.

In Comparative Examples 25 to 27, the momentum $F_A$ of the water-blocking water was smaller than the momentum $F_B$ of the cooling water, and thus the cooling ability of the cooling water to cool the hot-rolled steel sheet 10 was not degraded. However, the condition (I) was not satisfied, and blocking the cooling water was not appropriately performed.

In Comparative Example 28, the condition (1) was satisfied, and the cooling ability of the cooling water to cool the hot-rolled steel sheet 10 was not degraded. However, the height H at which the adjacent sprays of the water-blocking water had joined was 400 mm or less and thus the condition (2) was not satisfied, and blocking the cooling water was not appropriately performed.

In Comparative Example 29, the distance L between the water-blocking nozzle 22 and the surface of the hot-rolled steel sheet 10 was greater than 2000 mm and thus the condition (3) was not satisfied, and blocking the cooling water was not appropriately performed. In addition, in this case, the water-blocking water had submerged below the cooling water and the cooling ability of the cooling water to cool the hot-rolled steel sheet 10 was degraded.

Contrary to this, in Examples 11 to 15, all the conditions (1) to (3) were satisfied, and thus the cooling water could be appropriately blocked while appropriately cooling the hot-rolled steel sheet 10 by the cooling water.

According to the above verification results, it was confirmed that in the case where the sprayed water density of the cooling water was a high sprayed water density of higher than 4 $m^3/m^2/min$ and equal to or less than 10 $m^3/m^2/min$ and the water-blocking apparatus and the water-blocking method of the present invention were used, that is, all the conditions (1) to (3) were satisfied, the cooling water could be appropriately blocked while appropriately cooling the hot-rolled steel sheet 10 by the cooling water. In contrast, in a case where the sprayed water density of the cooling water was a low sprayed water density of equal to or less than 4 $m^3/m^2/min$ or any one of the conditions (1) to (3) was not satisfied, the cooling water could not be appropriately blocked while appropriately cooling the hot-rolled steel sheet 10 by the cooling water.

In addition, in Examples 1 to 15 described above, Examples 2, 7, and 12 in which "Water-blocking characteristics" was A are optimum examples. That is, conditions in which the spray angle $\theta_S$ of the water-blocking water is 50 degrees, the angle $\theta_A$ of attack of the water-blocking water is 30 degrees, and the interval P between the water-blocking nozzles 22 and 22 is 225 mm are optimum conditions.

Compared to the conditions, when the spray angle $\theta_S$ of the water-blocking water becomes greater than 50 degrees, the momentum $F_B$ of the cooling water is reduced. In contrast, when the spray angle $\theta_S$ of the water-blocking water becomes smaller than 50 degrees, the height H at which the adjacent sprays of the water-blocking water join is reduced.

In addition, when the angle $\theta_A$ of attack of the water-blocking water becomes greater than 30 degrees, the distance L between the water-blocking nozzle 22 and the surface of the hot-rolled steel sheet 10 is increased. In contrast, when the angle $\theta_A$ of attack of the water-blocking water becomes smaller than 30 degrees, the momentum $F_B$ of the cooling water is reduced.

In addition, when the interval P between the water-blocking nozzles 22 and 22 becomes greater than 225 mm, the momentum $F_B$ of the cooling water is reduced. In contrast, when the interval P between the water-blocking nozzles 22 and 22 becomes smaller than 225 mm, a large number of water-blocking nozzles 22 need to be provided, resulting in an increase in the cost of the apparatus.

TABLE 1

| | Cooling | Water-blocking water | | | | | | |
|---|---|---|---|---|---|---|---|---|
| No. | water Water amount $Q_B$ $m^3/m^2/min$ | Water amount $Q_A$ $m^3/m^2/min$ | Spray angle $\theta_S$ degrees | Angle of attack $\theta_A$ degrees | Pitch P m | Height $h_A$ m | Cooling water $F_B$ | Water-blocking water $F_A$ ≤ |
| Comparative Example 1 | 3.5 | 2.9 | 140 | 30 | 225 | 1000 | 4.53 | 5.35 |
| Comparative Example 2 | 3.5 | 2.9 | 130 | 30 | 225 | 1000 | 4.53 | 5.51 |
| Comparative Example 3 | 3.5 | 2.5 | 50 | 30 | 225 | 1000 | 4.53 | 5.47 |
| Comparative Example 4 | 3.5 | 2.5 | 20 | 30 | 225 | 1000 | 4.53 | 5.58 |
| Comparative Example 5 | 3.5 | 3.8 | 50 | 20 | 225 | 1000 | 4.53 | 5.61 |
| Comparative Example 6 | 3.5 | 3.8 | 50 | 30 | 325 | 1000 | 4.53 | 5.68 |
| Comparative Example 7 | 3.5 | 2.5 | 50 | 60 | 225 | 1000 | 4.53 | 9.47 |
| Comparative Example 8 | 3.5 | 2.5 | 15 | 30 | 225 | 1000 | 4.53 | 5.59 |
| Comparative Example 9 | 3.5 | 2.5 | 50 | 65 | 225 | 1000 | 4.53 | 9.91 |
| Comparative Example 10 | 3.5 | 3.8 | 50 | 10 | 225 | 1000 | 4.53 | 2.85 |
| Comparative Example 11 | 3.5 | 3.8 | 50 | 30 | 425 | 1000 | 4.53 | 4.34 |
| Example 1 | 4.2 | 2.9 | 130 | 30 | 225 | 1000 | 5.44 | 5.51 |
| Example 2 | 4.2 | 3.4 | 50 | 30 | 225 | 1000 | 5.44 | 7.29 |
| Example 3 | 4.2 | 3.6 | 20 | 30 | 225 | 1000 | 5.44 | 7.90 |
| Example 4 | 4.2 | 3.8 | 50 | 20 | 225 | 1000 | 5.44 | 5.61 |
| Example 5 | 4.2 | 4.0 | 50 | 30 | 325 | 1000 | 5.44 | 5.99 |
| Comparative Example 12 | 4.2 | 2.5 | 50 | 60 | 225 | 1000 | 5.44 | 9.47 |
| Comparative Example 13 | 4.2 | 2.9 | 140 | 30 | 225 | 1000 | 5.44 | 5.35 |

TABLE 1-continued

| | | | | | | | | |
|---|---|---|---|---|---|---|---|---|
| Comparative Example 14 | 4.2 | 3.8 | 50 | 10 | 225 | 1000 | 5.44 | 2.85 |
| Comparative Example 15 | 4.2 | 4.0 | 50 | 30 | 425 | 1000 | 5.44 | 4.58 |
| Comparative Example 16 | 4.2 | 2.9 | 15 | 30 | 225 | 1000 | 5.44 | 6.52 |
| Comparative Example 17 | 4.2 | 2.5 | 50 | 65 | 225 | 1000 | 5.44 | 9.91 |
| Example 6 | 6.0 | 4.2 | 130 | 30 | 225 | 1000 | 7.76 | 7.87 |
| Example 7 | 6.0 | 4.8 | 50 | 30 | 225 | 1000 | 7.76 | 10.41 |
| Example 8 | 6.0 | 5.1 | 20 | 30 | 225 | 1000 | 7.76 | 11.29 |
| Example 9 | 6.0 | 5.4 | 50 | 20 | 225 | 1000 | 7.76 | 8.01 |
| Example 10 | 6.0 | 5.7 | 50 | 30 | 325 | 1000 | 7.76 | 8.56 |
| Comparative Example 18 | 6.0 | 3.6 | 50 | 60 | 225 | 1000 | 7.76 | 13.53 |
| Comparative Example 19 | 6.0 | 4.2 | 140 | 30 | 225 | 1000 | 7.76 | 7.65 |
| Comparative Example 20 | 6.0 | 5.4 | 50 | 10 | 225 | 1000 | 7.76 | 4.07 |
| Comparative Example 21 | 6.0 | 5.7 | 50 | 30 | 425 | 1000 | 7.76 | 6.55 |
| Comparative Example 22 | 6.0 | 4.2 | 15 | 30 | 225 | 1000 | 7.76 | 9.31 |
| Comparative Example 23 | 6.0 | 3.6 | 50 | 65 | 225 | 1000 | 7.76 | 14.16 |
| Example 11 | 8.0 | 5.6 | 130 | 30 | 225 | 1000 | 10.35 | 10.50 |
| Example 12 | 8.0 | 6.4 | 50 | 30 | 225 | 1000 | 10.35 | 13.89 |
| Example 13 | 8.0 | 6.8 | 20 | 30 | 225 | 1000 | 10.35 | 15.05 |
| Example 14 | 8.0 | 7.2 | 50 | 20 | 225 | 1000 | 10.35 | 10.69 |
| Example 15 | 8.0 | 7.6 | 50 | 30 | 325 | 1000 | 10.35 | 11.42 |
| Comparative Example 24 | 8.0 | 4.8 | 50 | 60 | 225 | 1000 | 10.35 | 18.04 |
| Comparative Example 25 | 8.0 | 5.6 | 150 | 30 | 225 | 1000 | 10.35 | 9.87 |
| Comparative Example 26 | 8.0 | 7.2 | 50 | 10 | 225 | 1000 | 10.35 | 5.43 |
| Comparative Example 27 | 8.0 | 7.6 | 50 | 30 | 425 | 1000 | 10.35 | 8.73 |
| Comparative Example 28 | 8.0 | 5.6 | 15 | 30 | 225 | 1000 | 10.35 | 12.42 |
| Comparative Example 29 | 8.0 | 4.8 | 50 | 65 | 225 | 1000 | 10.35 | 18.88 |

| No. | $F_A/F_B$ — | Water-blocking height H >400 mm | Nozzle distance L ≤2000 mm | Cooling ability degradation — | Water-blocking characteristics — | Evaluation — |
|---|---|---|---|---|---|---|
| Comparative Example 1 | 1.18 | 965 | 1155 | C | B | B |
| Comparative Example 2 | 1.22 | 955 | 1155 | C | B | B |
| Comparative Example 3 | 1.21 | 791 | 1155 | C | A | B |
| Comparative Example 4 | 1.23 | 447 | 1155 | C | B | B |
| Comparative Example 5 | 1.24 | 773 | 1064 | C | B | B |
| Comparative Example 6 | 1.25 | 698 | 1155 | C | B | B |
| Comparative Example 7 | 2.09 | 879 | 2000 | C | A | B |
| Comparative Example 8 | 1.23 | 260 | 1155 | C | C | B |
| Comparative Example 9 | 2.19 | 898 | 2366 | C | C | B |
| Comparative Example 10 | 0.63 | 762 | 1015 | A | C | B |
| Comparative Example 11 | 0.96 | 605 | 1155 | A | C | B |
| Example 1 | 1.01 | 955 | 1155 | A | B | A |
| Example 2 | 1.34 | 791 | 1155 | B | A | A |
| Example 3 | 1.45 | 447 | 1155 | B | B | A |
| Example 4 | 1.03 | 773 | 1064 | A | B | A |
| Example 5 | 1.10 | 698 | 1155 | A | B | A |
| Comparative Example 12 | 1.74 | 879 | 2000 | C | A | B |

TABLE 1-continued

| | | | | | | |
|---|---|---|---|---|---|---|
| Comparative Example 13 | 0.98 | 965 | 1155 | A | C | B |
| Comparative Example 14 | 0.52 | 762 | 1015 | A | C | B |
| Comparative Example 15 | 0.84 | 605 | 1155 | A | C | B |
| Comparative Example 16 | 1.20 | 260 | 1155 | A | C | B |
| Comparative Example 17 | 1.82 | 898 | 2366 | A | C | B |
| Example 6 | 1.01 | 955 | 1155 | A | B | A |
| Example 7 | 1.34 | 791 | 1155 | B | A | A |
| Example 8 | 1.45 | 447 | 1155 | B | B | A |
| Example 9 | 1.03 | 773 | 1064 | A | B | A |
| Example 10 | 1.10 | 698 | 1155 | A | B | A |
| Comparative Example 18 | 1.74 | 879 | 2000 | C | A | B |
| Comparative Example 19 | 0.98 | 965 | 1155 | A | C | B |
| Comparative Example 20 | 0.52 | 762 | 1015 | A | C | B |
| Comparative Example 21 | 0.84 | 605 | 1155 | A | C | B |
| Comparative Example 22 | 1.20 | 260 | 1155 | A | C | B |
| Comparative Example 23 | 1.82 | 898 | 2366 | A | C | B |
| Example 11 | 1.01 | 955 | 1155 | A | B | A |
| Example 12 | 1.34 | 791 | 1155 | B | A | A |
| Example 13 | 1.45 | 447 | 1155 | B | B | A |
| Example 14 | 1.03 | 773 | 1064 | A | B | A |
| Example 15 | 1.10 | 698 | 1155 | A | B | A |
| Comparative Example 24 | 1.74 | 879 | 2000 | C | A | B |
| Comparative Example 25 | 0.95 | 974 | 1155 | A | C | B |
| Comparative Example 26 | 0.52 | 762 | 1015 | A | C | B |
| Comparative Example 27 | 0.84 | 605 | 1155 | A | C | B |
| Comparative Example 28 | 1.20 | 260 | 1155 | A | C | B |
| Comparative Example 29 | 1.82 | 898 | 2366 | A | C | B |

INDUSTRIAL APPLICABILITY

The present invention is useful for blocking cooling water sprayed onto a hot-rolled steel sheet when the hot-rolled steel sheet is cooled after finish rolling of a hot-rolling process.

BRIEF DESCRIPTION OF THE REFERENCE SYMBOLS

1: HOT ROLLING FACILITY
10: HOT-ROLLED STEEL SHEET
11: HEATING FURNACE
12: WIDTH-DIRECTION ROLLING MILL
13: ROUGHING MILL
13*a*: WORK ROLL
13*b*: FOUR-HIGH MILL
14: FINISHING MILL
14*a*: FINISHING ROLL
15: COOLING APPARATUS
16: WATER-BLOCKING APPARATUS
17: COILER
18: TRANSPORTING ROLL
20: COOLING WATER NOZZLE
21: THE OTHER COOLING WATER NOZZLE
22: WATER-BLOCKING NOZZLE
30: IMPACT AREA

The invention claimed is:

1. A water-blocking apparatus for cooling water for a hot-rolled steel sheet, which blocks cooling water sprayed onto the hot-rolled steel sheet at a sprayed water density of higher than 4 $m^3/m^2/min$ and equal to or less than 10 $m^3/m^2/min$ when the hot-rolled steel sheet is cooled after finish rolling of a hot-rolling process, the water-blocking apparatus comprising:

a plurality of water-blocking nozzles which are flat spray nozzles spraying water-blocking water onto the hot-rolled steel sheet, wherein the plurality of the water-blocking nozzles are arranged so that impact areas of the water-blocking water respectively sprayed from the water-blocking nozzles are continuously lined up in a straight line in a width direction of the hot-rolled steel sheet on a surface of the hot-rolled steel sheet and the adjacent impact areas partially overlap, the plurality of the water-blocking nozzles are configured to form a water wall continuously extending along the width direction on the impact areas, and a momentum $F_A$ of the water-blocking water that flows in the sheet-threading direction of the hot-rolled steel sheet on the surface of the hot-rolled steel sheet is 1.0 to 1.45 times a momentum $F_B$ of the cooling water that flows in the sheet-threading direction of the hot-rolled steel sheet.

2. The water-blocking apparatus for cooling water for a hot-rolled steel sheet according to claim 1, wherein a height at which sprays of the water-blocking water which are adjacent to each other in the width direction of the hot-rolled steel sheet join is higher than 400 mm from the surface of the hot-rolled steel sheet in a side view as viewed from a sheet-threading direction of the hot-rolled steel sheet.

3. The water-blocking apparatus for cooling water for a hot-rolled steel sheet according to claim 1, wherein the plurality of water-blocking nozzles are lined up and arranged in the width direction of the hot-rolled steel sheet so that a distance between the water-blocking nozzle and the surface of the hot-rolled steel sheet in a spraying direction of the water-blocking water is 2000 mm or less.

4. The water-blocking apparatus for cooling water for a hot-rolled steel sheet according to claim 1, wherein a spray angle of the water-blocking water sprayed from the water-blocking nozzle with respect to a vertical direction is 20 to 65 degrees.

5. The water-blocking apparatus for cooling water for a hot-rolled steel sheet according to claim 1, wherein the plurality of water-blocking nozzles are arranged on each of an upstream side and a downstream side of a cooling water nozzle which sprays the cooling water onto the hot-rolled steel sheet.

6. A water-blocking method for cooling water for a hot-rolled steel sheet, in which cooling water sprayed onto the hot-rolled steel sheet at a sprayed water density of higher than 4 $m^3/m^2/min$ and equal to or less than 10 $m^3/m^2/min$ when the hot-rolled steel sheet is cooled after finish rolling of a hot-rolling process is blocked by water-blocking water sprayed from a plurality of water-blocking nozzles which are flat spray nozzles, the water-blocking method comprising:

spraying the water-blocking water from the plurality of the water-blocking nozzles onto the hot-rolled steel sheet so that a plurality of impact areas of the water-blocking water are continuously lined up in a straight line in a width direction of the hot-rolled steel sheet on a surface of the hot-rolled steel sheet and the adjacent impact areas partially overlap; and forming a water wall continuously extending along the width direction on the impact areas, wherein a momentum F of the water-blocking water that flows in the sheet-threading direction of the hot-rolled steel sheet on the surface of the hot-rolled steel sheet is 1.0 to 1.45 times a momentum $F_B$ of the cooling water that flows in the sheet-threading direction of the hot-rolled steel sheet.

7. The water-blocking method for cooling water for a hot-rolled steel sheet according to claim 6, wherein a height at which sprays of the water-blocking water which are adjacent to each other in the width direction of the hot-rolled steel sheet join is higher than 400 mm from the surface of the hot-rolled steel sheet in a side view as viewed from a sheet-threading direction of the hot-rolled steel sheet.

8. The water-blocking method for cooling water for a hot-rolled steel sheet according to claim 6, wherein the plurality of water-blocking nozzles are lined up and arranged in the width direction of the hot-rolled steel sheet so that a distance between the water-blocking nozzle and the surface of the hot-rolled steel sheet in a spraying direction of the water-blocking water is 2000 mm or less.

9. The water-blocking method for cooling water for a hot-rolled steel sheet according to claim 6, wherein a spray angle of the water-blocking water sprayed from the water-blocking nozzle with respect to a vertical direction is 20 to 65 degrees.

10. The water-blocking method for cooling water for a hot-rolled steel sheet according to claim 6, wherein the plurality of water-blocking nozzles are arranged on each of an upstream side and a downstream side of a cooling water nozzle which sprays the cooling water onto the hot-rolled steel sheet, and the cooling water on the upstream side and the downstream side of the cooling water nozzle is blocked by the water-blocking water sprayed from the water-blocking nozzles disposed on the upstream side and the downstream side of the cooling water nozzle.

* * * * *